US007287887B2

(12) United States Patent
Ohshio et al.

(10) Patent No.: US 7,287,887 B2
(45) Date of Patent: Oct. 30, 2007

(54) VEHICLE HEADLAMP

(75) Inventors: Hirohiko Ohshio, Shizuoka (JP); Atsushi Sugimoto, Shizuoka (JP); Naoki Tatara, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 59 days.

(21) Appl. No.: 11/188,654

(22) Filed: Jul. 26, 2005

(65) Prior Publication Data

US 2006/0023465 A1 Feb. 2, 2006

(30) Foreign Application Priority Data

Jul. 29, 2004 (JP) ..... P. 2004-221458
Jul. 29, 2004 (JP) ..... P. 2004-221459

(51) Int. Cl.
*F21V 17/02* (2006.01)

(52) U.S. Cl. ..... 362/512; 362/523; 362/508; 362/465; 362/277; 362/319

(58) Field of Classification Search ..... 362/508–509, 362/460, 512, 523, 464–465, 277, 280, 319
See application file for complete search history.

(56) References Cited

U.S. PATENT DOCUMENTS 4,951,178 A * 8/1990 Shirai et al. ..... 362/512
5,785,416 A * 7/1998 Hansen ..... 362/280
6,866,407 B2 * 3/2005 Park ..... 362/508
7,045,984 B2 * 5/2006 Gonschor ..... 318/480
7,083,303 B2 * 8/2006 Scholz ..... 362/290
2001/0040810 A1 * 11/2001 Kusagaya ..... 362/351
2002/0075693 A1 * 6/2002 Rosenhahn et al. ..... 362/513
2002/0122310 A1 * 9/2002 DiPenti et al. ..... 362/512
2003/0112635 A1 * 6/2003 Tatsukawa ..... 362/512
2003/0165066 A1 * 9/2003 Watanabe et al. ..... 362/523
2004/0145907 A1 * 7/2004 Suzuki ..... 362/513

FOREIGN PATENT DOCUMENTS

JP 2001-202809 A 7/2001
JP 2002-42516 A 2/2002
JP 2002-56708 A 2/2002

* cited by examiner

*Primary Examiner*—Tom M. Sember
*Assistant Examiner*—Julie A. Shallenberger
(74) *Attorney, Agent, or Firm*—Sughrue Mion Pllc.

(57) ABSTRACT

A movable shade is moved by a shade driving device between a first shade position which is positioned on an optical axis at a rear focal point of a projection lens and a second shade position which is located further downward than the first shade position. Even in the event that there is provided only a single light source, low beam light distribution patterns and high beam light distribution patterns can selectively be formed. In addition, the light source is moved by a light source driving device between a first light source position which is positioned on the optical axis and a second light source position which is positioned further forward than the first light source position. Then, four types of light distribution patterns can be formed through combinations of the positions of the light source and the positions of the movable shade.

20 Claims, 21 Drawing Sheets

VEHICLE HEADLAMP

The present application claims foreign priority based on Japanese Patent Applications: P.2004-221458, filed on Jul. 29, 2004, and P.2004-221459, filed on Jul. 29, 2004, the contents of which are incorporated herein by reference.

BACKGROUND OF THE INVENTION

1. Field of the Invention

The present invention relates to a projector type vehicle headlamp and more particularly to a vehicle headlamp with a movable shade.

2. Related Art

One type of projector type vehicle headlamp is provided with a projection lens disposed on an optical axis which extends in the longitudinal direction of the vehicle and a light source disposed further rearward than a rear focal point of the projection lens. Light from the light source is designed to be reflected to approach the optical axis by a reflector. When low beam light distribution pattern is formed by the projector type vehicle headlamp, part of reflected light from the reflector is intercepted by a shade which is disposed in such a manner that an upper end edge of the shade is located close to the optical axis in the vicinity of the rear focal point of the projection lens, so that a predetermined cut-off line is formed at an upper end portion of a low beam light distribution pattern.

Disclosed in JP-A-2002-056708 is a projector type vehicle headlamp which has, as the shade, a movable shade that moves between a first shape position where an upper end edge of the movable shade is located close to the optical axis in the vicinity of the rear focal point and a second shade position where the position of the upper end edge is located below the position thereof resulting when the movable shade is located at the first shade position.

Disclosed in JP-A-2002-042516 is a projector type vehicle headlamp with the aforesaid shade in which there is provided a light driving device for moving the light source between a first light source position which is located close to the optical axis and a second light source position which is located to the left or right of or below the first light source position.

In the vehicle headlamp described in JP-A-2002-056708, since a high beam light distribution pattern can be formed by moving the movable shade to the second shade position, the single lamp can be used to form both the low bean and high beam light distribution patterns.

In the vehicle headlamp described in JP-A-2002-042516, however, since the low beam light distribution pattern and the high beam light distribution pattern are formed by reflected light from the same reflecting area of the reflector, there is caused a problem that in the event that the reflecting area is formed into a reflecting surface shape which is suitable for the low beam light distribution pattern, a light distribution pattern which is suitable for the high beam light distribution pattern cannot always be obtained, whereas in the event that the reflecting area is formed into a reflecting surface shape which is suitable for the high beam light distribution pattern, a light distribution pattern which is suitable for the low beam light distribution pattern cannot always be obtained.

On the other hand, in the event that a lamp configuration with a movable light source such as described in JP-A-2002-042516, the luminous intensity distribution of the high beam light distribution pattern can be changed by moving the light source.

In the vehicle headlamp described in JP-A-2002-042516, however, since the shade is of a stationary type, there is caused a problem that a high beam light distribution pattern cannot be obtained. In addition, as is described in JP-A-2002-042516, there is caused another problem that the luminous intensity distribution of the low beam light distribution pattern can be changed but the degree of gathering light cannot be changed only by moving the light source in a direction which intersects with the optical axis at right angles.

These problems are problems that will be occurring not only when the low beam light distribution pattern is switched over to the high beam light distribution pattern or vice versa but also when the low beam light distribution pattern is switched over to an intermediate light distribution pattern (which is a light distribution pattern positioned at a middle between the low beam light distribution and the high beam light distribution) or vice versa.

SUMMARY OF THE INVENTION

One or more embodiments of the present invention provide a projector type vehicle headlamp with a movable shade which can form an appropriate light distribution pattern even in the event that the movable shade is moved to any position.

According to one or more embodiments of the present invention, both a shade and a light source are made movable and to interlock with each other, and the moving direction of the light source is devised.

In accordance with one or more embodiments of the present invention, a vehicle headlamp is provided with a projection lens, a light source movable between a first light source position and a second light source position, a reflector, and a movable shade movable between a first shade position and a second shade position. The light source and the movable shade are able to interlock.

In accordance with one or more embodiments of the present invention, the projection lens is disposed on an optical axis extending in a longitudinal direction of a vehicle, the light source is disposed further rearward than a rear focal point of the projection lens, the reflector reflects light from the light source forward so as to approach the optical axis, the movable shade intercepts part of reflected light from the reflector, the first light source position is located in the vicinity of the optical axis, the second light source position is located further forward than the first light source position, in the first shade position, an upper end edge of the movable shade is located close to the optical axis in the vicinity of the rear focal point, and in the second shade position, the upper end edge is located below a position when the movable shade is located at the first shade position.

In accordance with one or more embodiments of the present invention, a reflecting surface of the reflector has a substantially oval perpendicular cross section having a first focal point close to the first light source position and a second focal point located further forward than the rear focal point in the vicinity of the optical axis.

In accordance with one or more embodiments of the present invention, wherein the second light source position is below the first light source position.

In accordance with one or more embodiments of the present invention, the vehicle headlamp is further provided with a stationary shade disposed in the vicinity of the rear focal point and intercepts part of reflected light from the reflector. The height position of an upper end edge of the stationary shade is positioned between a height position of an upper end edge of the movable shade when the movable shade is located at the first shade position and a height position of the upper end edge of the movable shade when the movable shade is located at the second shade position.

In accordance with one or more embodiments of the present invention, the vehicle headlamp is further provided with a light source driving device that drives the light source, and a shade driving device that drive the movable shade.

In accordance with one or more embodiments of the present invention, the light source and the movable shade are supported by a common support member.

In accordance with one or more embodiments of the present invention, the support member is moved by a driving device between a first shift position where the light source is located at the first light source position and the movable shade is located at the first shade position and a second shift position where the light source is located at the second light source position and the movable shade is located at the second shade position.

In accordance with one or more embodiments of the present invention, the second light source position is forward the first light source position.

Other aspects and advantages of the invention will be apparent from the following description and the appended claims.

Further, the kind of the light source is not specifically limited, and for example, a discharge light emitting portion of a discharge bulb and a filament of a halogen bulb can be adopted.

While the second light source position is not specifically limited, provided that it is positioned further forward of the first light source position, the second light source is preferably positioned on the order of 1 to 3 mm further forward than the first light source position, and the same light source is more preferably positioned on the order of 1.5 to 2.5 mm than the first light source position.

There is no specific limitation that is imposed on the configuration of the reflector including the size thereof and the shape of a reflecting surface thereof, provided that the reflector is such as to be configured to reflect light from the light source forward so as to approach the optical axis.

There is no specific limitation that is imposed on the configuration of the movable shade including the shape and size thereof. In addition, while the movable shade is configured to intercept part of reflected light from the reflector, as this occurs, when located at the second shade position, the movable shade may be configured to completely release the interception of the reflected light or to partially release the interception of the reflected light, provided that when located at the first shade position, the movable shade is configured to intercept part of the reflected light.

While there is no particular limitation that is imposed on the position of the second shade position, provided that the second shade position is located below the first shade position, the downward deviation distance of the second shade position is preferably set to be 3 mm or greater, and the downward deviation distance thereof is more preferably set to be 3.5 mm or greater from the viewpoint that the interception release is implemented effectively.

There is no specific limitation that is imposed on the configuration of the light source driving device, provided that the light source driving device is such as to be configured to move the light source between the first light source position and the second light source position, and for example, a solenoid and a pulse motor can be adopted. In addition, there is no specific limitation that is imposed on the mode of moving the light source through the driving of the light source driving device, and for example, moving modes based on rotational motion and rectilinear reciprocating motion can be adopted.

There is no specific limitation that is imposed on the configuration of the shade driving device, provided that the shade driving device is configured to move the movable shade between the first shade position and the second shade position, and for example, a solenoid and a pulse motor can be adopted. In addition, there is no specific limitation that is imposed on the mode of moving the movable shade through the driving of the shade driving device, and for example, moving modes based on rotational motion and rectilinear reciprocating motion can be adopted.

The light source driving device and the shade driving device may be configured to normally interlock with each other for driving or configured to arbitrarily interlock with each other for driving, provided that the light source driving device and the shade driving device are configured to interlock with each other for driving.

Further, there is no specific limitation that is imposed on the configuration of the driving device, provided that the driving device is configured so as to move the support member which supports the light source and the movable shade between the first and second shift positions, and for example, a solenoid and a pulse motor can be adopted. In addition, there is no specific limitation that is imposed on the mode of moving the support member through the driving of the driving device, and for example, modes utilizing rotational and rectilinear motions can be adopted.

DESCRIPTION OF THE PREFERRED EMBODIMENTS

Embodiments of the invention will be described with reference to the accompanying drawings.

Figure 1:
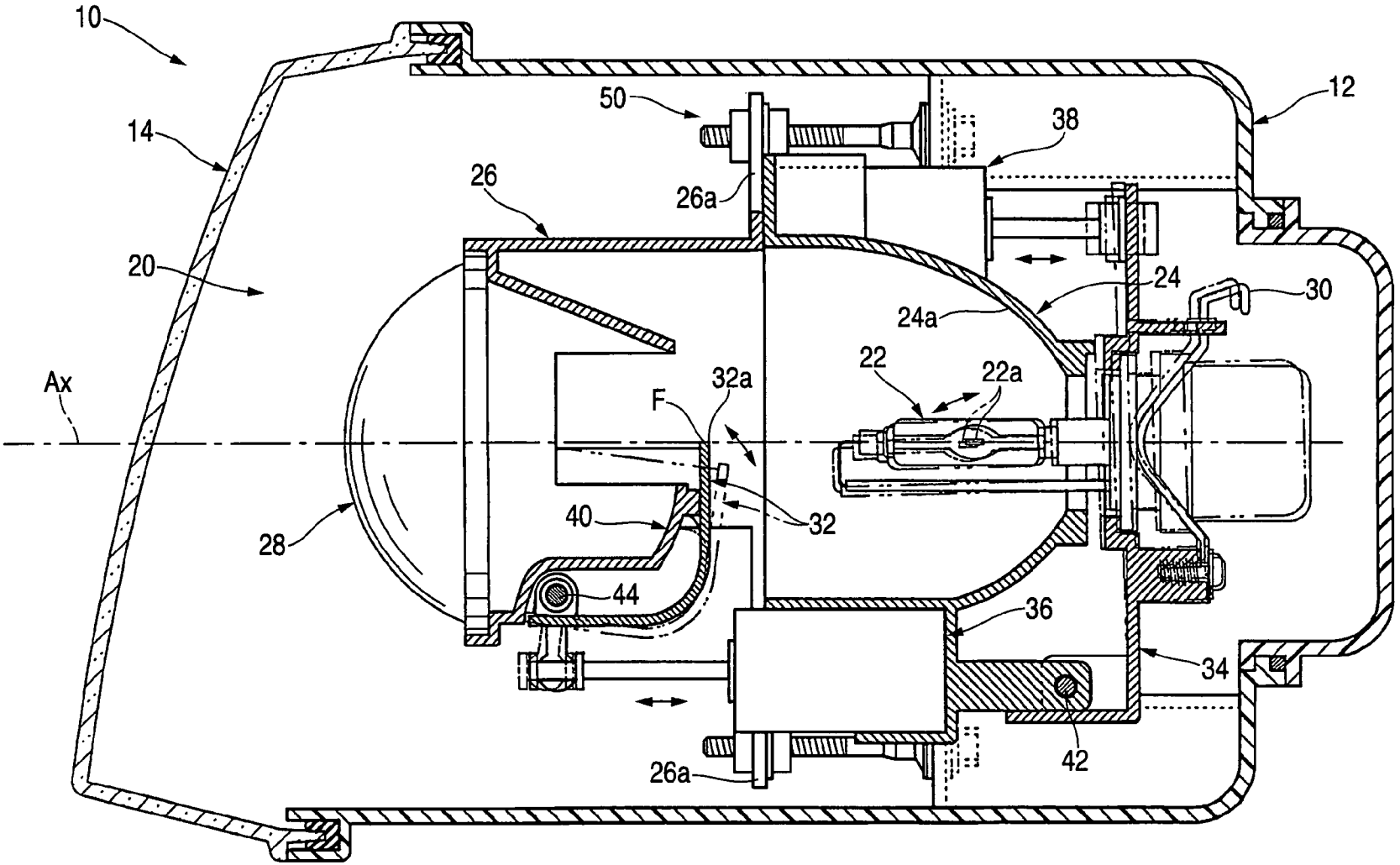
FIG. 1 is a side sectional view showing a vehicle headlamp according to one or more embodiments of the invention.

FIG. 1 is a side sectional view of a vehicle headlamp 10 according to first embodiment of the invention.

As shown in FIG. 1, a vehicle headlamp 10 is constructed such that a lamp unit 20 having an optical axis Ax which extends in a longitudinal direction of a vehicle is accommodated within a lamp compartment which is defined by a lamp body 12 and a transparent, light transmitting cover 14 which is mounted over a front end opening of the lamp body 12 via an aiming mechanism 50 in such a manner as to be tilted vertically and horizontally.

Then, in the vehicle headlamp 10, at a stage where the aiming adjustment by the aiming mechanism 50 is completed, the optical axis Ax of the lamp unit 20 is made to extend on the order of 0.5 to 0.6° downwards relative to the longitudinal direction of the vehicle.

Figure 2:
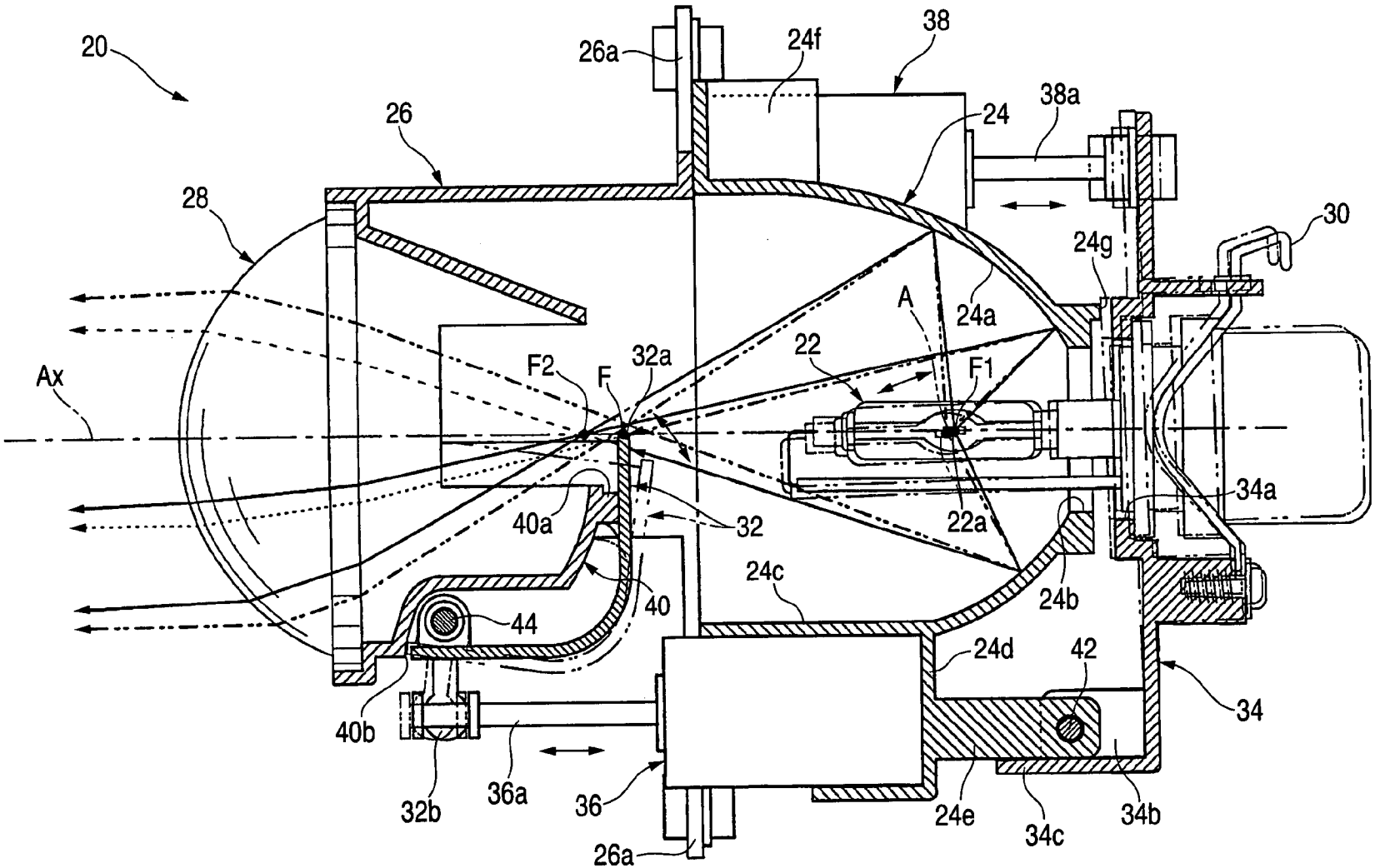
FIG. 2 is a side sectional view showing a lamp unit of the vehicle headlamp singly.
Figure 3:
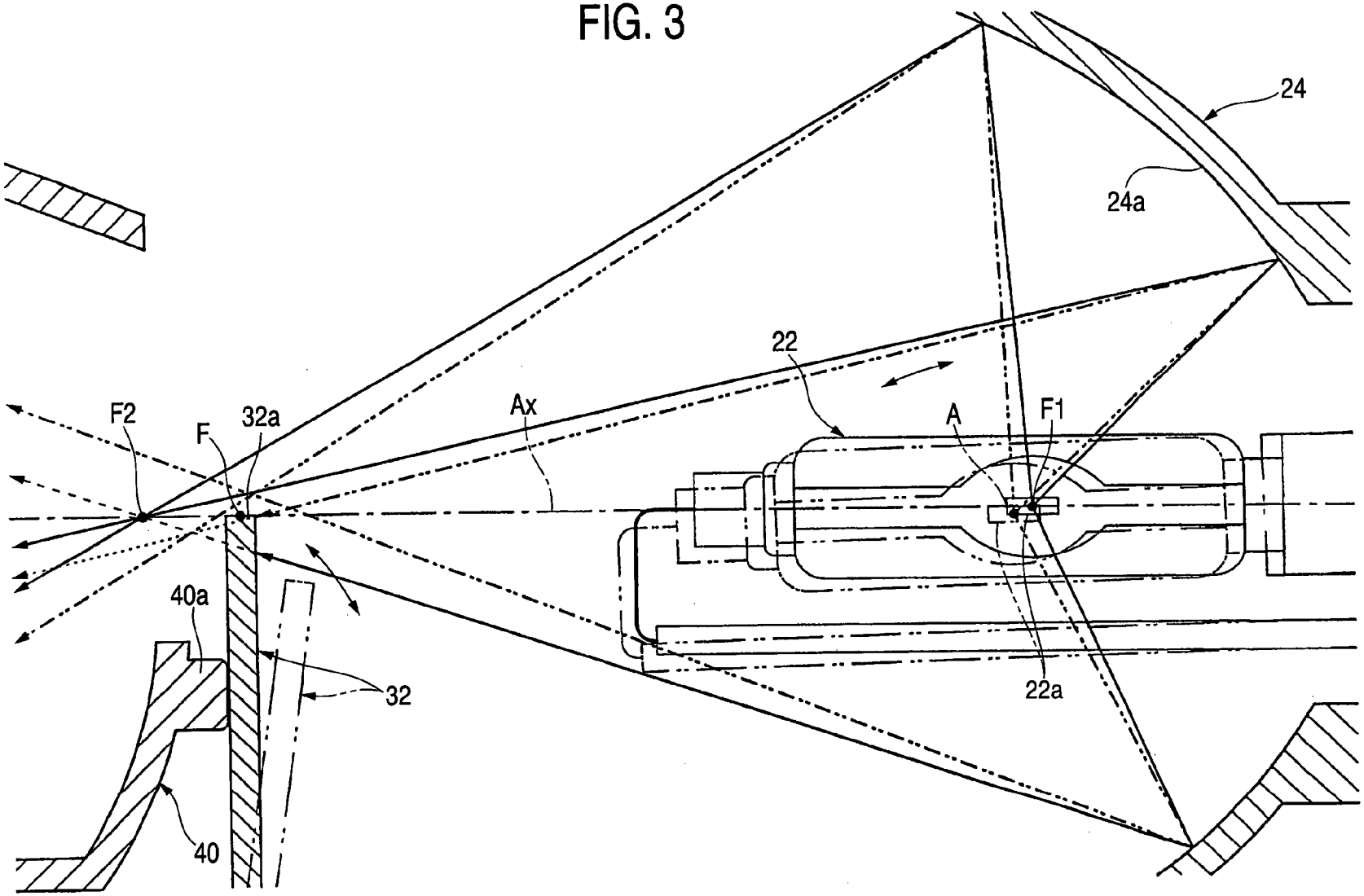
FIG. 3 is a detailed drawing of a main part of FIG. 2.

FIG. 2 is a side sectional view showing the lamp unit 20 singly, and FIG. 3 is a detailed view of a main part of FIG. 2.

Also as shown in FIGS. 2 and 3, the lamp unit 20 is a projector type lamp unit and includes a light source bulb 22, a reflector 24, a holder 26, a projection lens 28, a movable shade 32, a bulb support base 34, a shade driving device 36 and a light source driving device 38.

The projection lens 28 is made up of a planoconvex lens with a front side surface convex and a back side surface plane and is disposed on the optical axis. Then, the projection lens 28 is made to project forward, as an inverted image, an image on a rear focal plane thereof which includes the rear focal point F.

The light source bulb 22 is a discharge bulb such as a metal halide bulb in which a discharge light emitting portion constitutes a light source 22*a* and is inserted in an opening at a rear apex of the reflector 24 in such a state that the light source bulb 22 is securely inserted in a bulb inserting and attaching portion 34*a* of the bulb support base 34 from the rear thereof and is then fixed in place by means of a wire spring 30. The light source 22*a* of the light source bulb 22 is disposed further rearward than the rear focal point F of the projection lens 28 and is disposed in such a manner as to extend along the optical axis Ax on the same optical axis Ax when it is located at a first light source position, which will be described later.

The reflector 24 is made to reflect light from the light source 22*a* forward in such a manner that light so reflected approaches the optical axis Ax. A reflecting surface 24*a* of the reflector 24 is set such that a cross section thereof which includes the optical axis Ax becomes an oval shape which takes the center of the light source on the optical axis Ax as a first focal point F1 and that the eccentricity thereof gradually increases from a perpendicular section toward a horizontal section thereof. In this case, a second focal point F2 of the oval which constitutes the perpendicular section which includes the optical axis Ax is set at a position which is located slightly further forward than the rear focal point F of the projection lens 28. Then, by this configuration, the reflector 24 is made to make light from the light source 22*a* which has been reflected on the reflecting surface 24*a* substantially converge at the second focal point F2 within the perpendicular cross section and is made to shift the convergence position rather forward within the horizontal section.

The holder 26 is formed in such a manner as to extend forward from the front end opening of the reflector 24 in a substantially cylindrical fashion and fixedly supports the reflector 24 and the projection lens 28 at a rear end portion and a front end portion, respectively. This holder 26 is cut away at a lower area thereof. In addition, a plurality of aiming brackets 26*a* are formed along a rear end circumferential edge portion for connecting the lamp unit 20 to the aiming mechanism 50.

The movable shade 32 is provided in such a manner as to be disposed substantially in a lower half portion within an interior space of the holder 26 and is rotatably supported on the holder 26 via a rotational pin 44 which extends transversely. Then, this movable shade 32 is made to take a first shade position which is indicated by solid lines in FIGS. 2 and 3 and a second shade position which results when the movable shade 32 is rotated a predetermined angle downward from the first shade position and which is indicated by double-dashed lines in FIGS. 2 and 3.

An upper end edge 32*a* of the movable shade 32 is formed in such a manner as to be stepped transversely or to form a transverse step and extends horizontally in an arc-like fashion. Then, this upper end edge 32*a* is disposed in such a manner as to pass through the rear focal point F of the projection lens 28 to thereafter extend along the rear focal point plane when the movable shade 32 is located at the first shade position, whereas when the movable shade 32 is moved to the second shade position, the upper end edge 32*a* is disposed further rearward and obliquely downward than its position resulting when the movable shade 32 is located at the first shade position. Then, when at the second shade position, the upper end edge 32*a* of the movable shade 32 is made to be located on the order of 4 mm further downward than its position resulting when the movable shade 32 is located at the first shade position.

A stationary shade 40 is formed integrally with the holder 26 in front of the movable shade 32 for preventing stray light that has been reflected on the reflector 24 from being incident on the projection lens 28. There are formed on this stationary shade 40 a positioning abutment portion 40*a* which is adapted to be brought into the movable shade 32 when the movable shade 32 is moved to the first shade position to thereby position the movable shade 32 at the first shade position and a positioning abutment portion 40*b* which is adapted to be brought into abutment with the movable shade 32 when the movable shade 32 is moved to the second shade position to thereby position the movable shade 32 at the second shade position.

The shade driving device 36 is made up of a solenoid having a plunger 36*a* which extends forward and is fixed to a unit mount portion 24*d* formed on a lower surface of a bottom wall 24*c* of the reflector 24. The plunger 36*a* of this shade driving device 36 is brought into engagement with a stay 32*b* formed in such a manner as to protrude downward from the movable shade 32 at a distal end portion thereof, whereby a longitudinal reciprocating motion of the plunger 36*a* is transmitted as a rotational motion of the movable shade 32. Then, this shade driving device 36 is driven when a beam change over switch is operated so as to move the plunger 36*a* in the longitudinal direction, so that the movable shade 32 is made to be moved between the first and second shade positions.

The bulb support base 34 is provided in such a manner as to be located in the vicinity of the rear of the rear apex opening 24*b* of the reflector 24 and is rotatably supported on the reflector 24 at a lower end portion thereof. Namely, this bulb support base 34 is connected to a distal end portion of a bracket 24*e* which extends from the unit mount portion 24*d* of the reflector 24 to the rear via a rotational pin 42 which extends transversely so as to rotate about the rotational pin 42. The rotational pin 42 is disposed at a position on the order of 10 to 30° further rearward than a perpendicular downward direction of the light source 22*a*.

The light source driving device 38 is made up of a solenoid having a plunger 38*a* which extends to the rear and is fixed to a unit mount portion 24*f* formed on an upper portion of the reflector 24. The plunger 38*a* of this light source driving device 38 is brought into engagement with an upper end portion of the bulb support base 34 at a distal end portion thereof and is made to transmit a longitudinal reciprocating motion of the plunger 38*a* as a rotational motion of the bulb support base 34. Then, this light source driving device 38 is driven by a drive signal from a drive control unit, not shown, so as to drive the plunger 38*a* in the longitudinal direction to thereby move the light source 22*a* between a first light source position where the center of the light source 22*a* is positioned at the first focal point F1 and a second light source position where the center of the light source 22*a* is positioned at a point A which is located further forward and slightly further downward than the first focal point F1. The specific position of this point A is set at a position on the order of 2 mm further forward and on the order of 0.5 mm further downward than the first focal point F1.

There is formed at a lower end portion of the bulb support base 34 a positioning abutment portion 34*c* which is adapted to be brought into abutment with the bracket 24*e* of the reflector when the light source 22*a* is moved to the first light source position to thereby position the light source 22*a* at the first light source position. In addition, there is formed on an upper portion of the rear apex opening 24*b* of the reflector 24 a positioning abutment portion 24*g* which is adapted to be brought into abutment with an upper end portion of the bulb inserting and attaching portion 34*a* of the bulb support base 34 when the light source 22*a* is moved to the second light source position to thereby position the light source 22*a* at the second light source position.

When the light source 22*a* is located at the first light source position, since the center of the light source 22*a* is located at the first focal point F1, light from the center of the light source 22*a* which is reflected on the reflector 24 intersects with the optical axis Ax at the second focal point F2 of the oval as indicated by solid lines in FIGS. 2 and 3. On the other hand, when the light source 22*a* is located at the second light source position, since the center of the light source 22*a* is located at the point A which is further forward and slightly further downward than the first focal point F1, light from the center of the light source 22*a* which is reflected on the reflector 24 intersects with the optical axis Ax at a point further rearward than the second focal point F2 as indicated by double-dashed lines in FIGS. 2 and 3.

As this occurs, since the second focal point F2 is located further forward than the rear focal point F of the projection lens 28, the degree at which reflected light from the reflector 24 is collected on the rear focal point plane of the projection lens 28 is made higher when the light source 22*a* is located at the first light source position than when the light source 22*a* is located at the second light source position. Moreover, since the second light source position is located not only further forward but also slightly further downward than the first light source position, a light collecting position on the rear focal point plane of the projection lens 28 is made to deviate slightly further upward than the optical axis Ax.

FIGS. 4 to 7 are side sectional views of the lamp unit 20 which show different optical paths resulting from combinations of the positions of the light source 22*a* and the positions of the movable shade 32.

Figure 4:
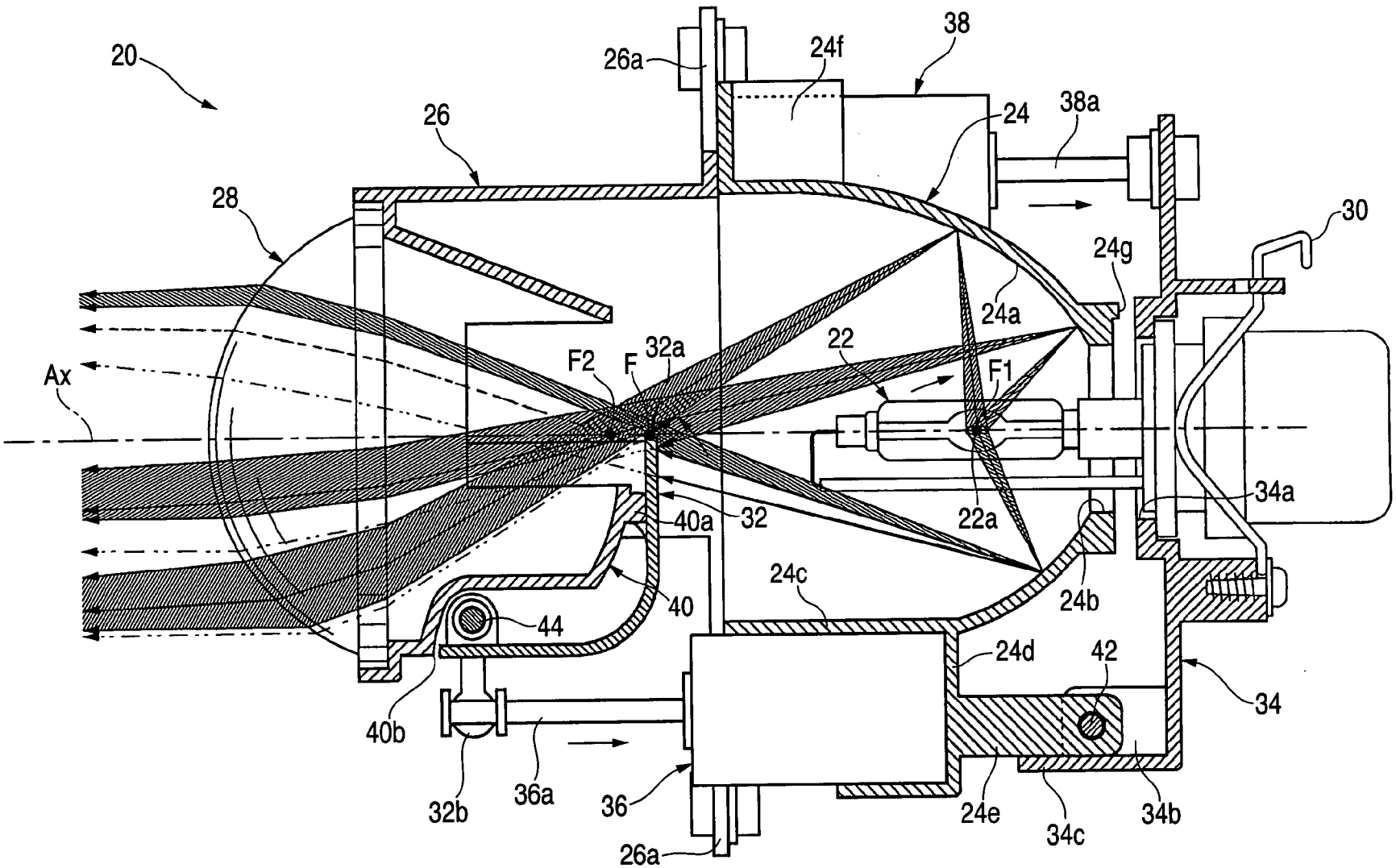
FIG. 4 is a side sectional view showing an optical path resulting when a light source is located at a first position thereof and a movable shade is located at a second position thereof.
Figure 5:
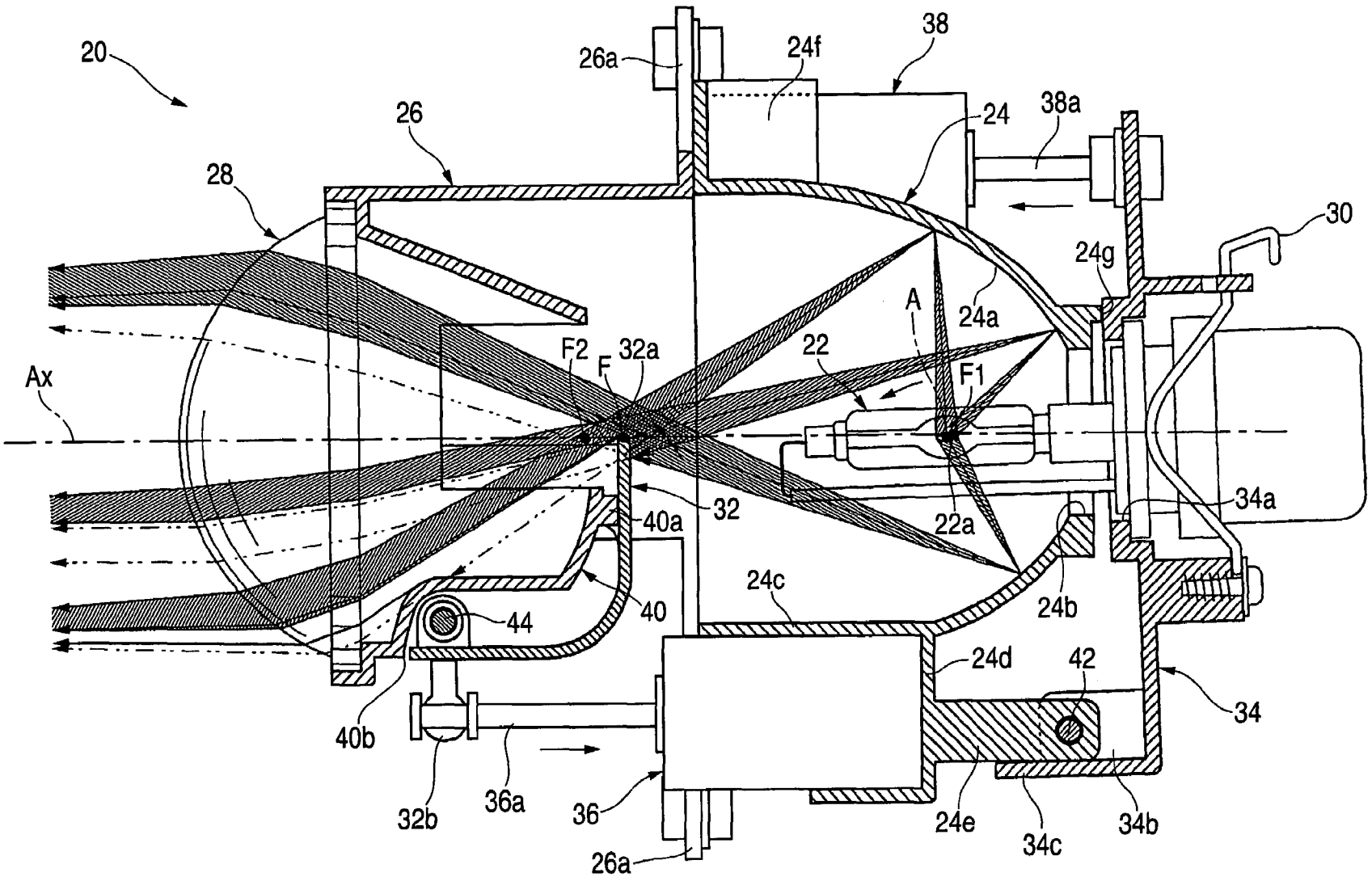
FIG. 5 is a side sectional view showing an optical path resulting when the light source is located at a second position thereof and the movable shade is located at a first position thereof.
Figure 6:
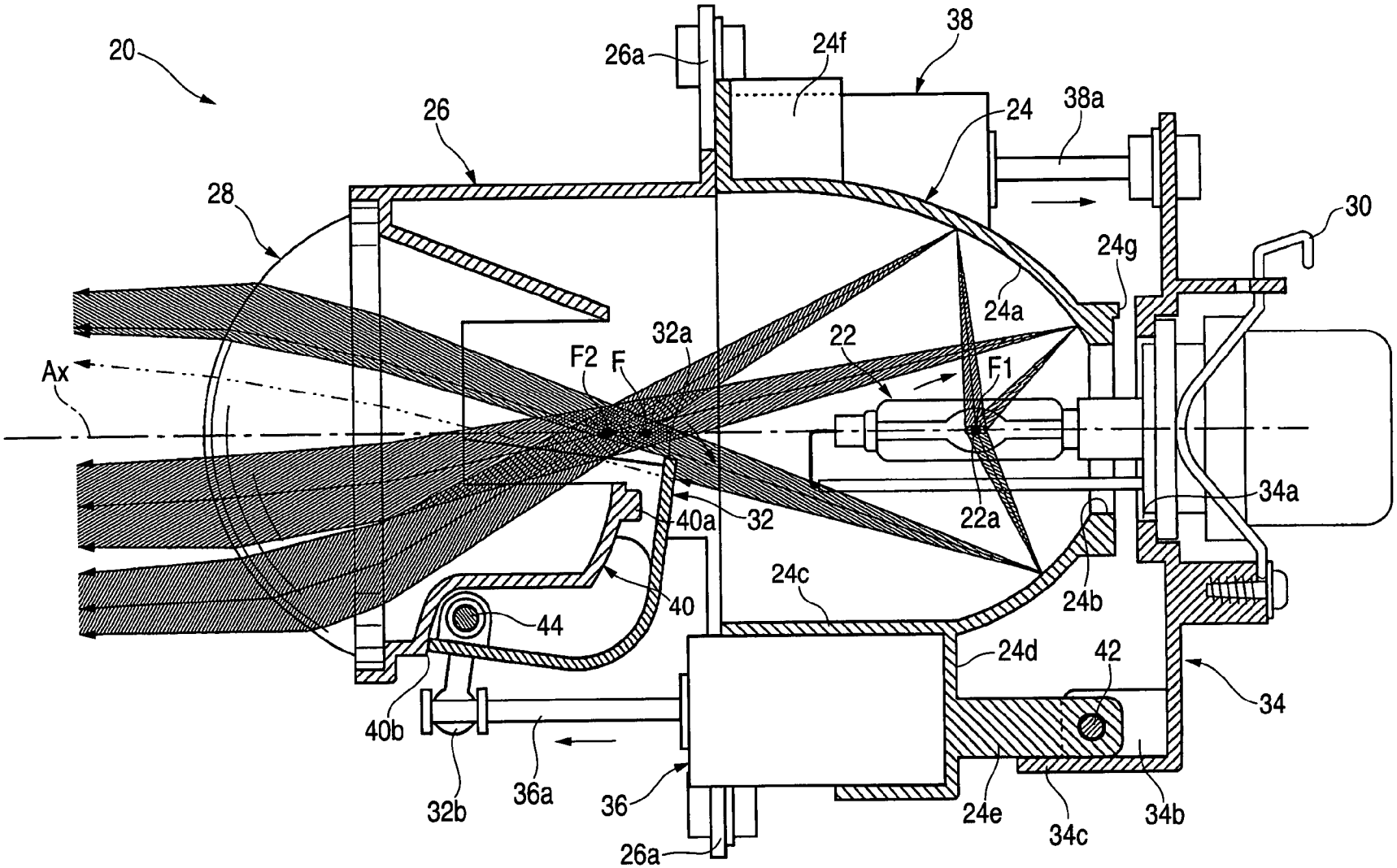
FIG. 6 is a side sectional view showing an optical path resulting when the light source is located at the first position thereof and the movable shade is located at the second position thereof.
Figure 7:
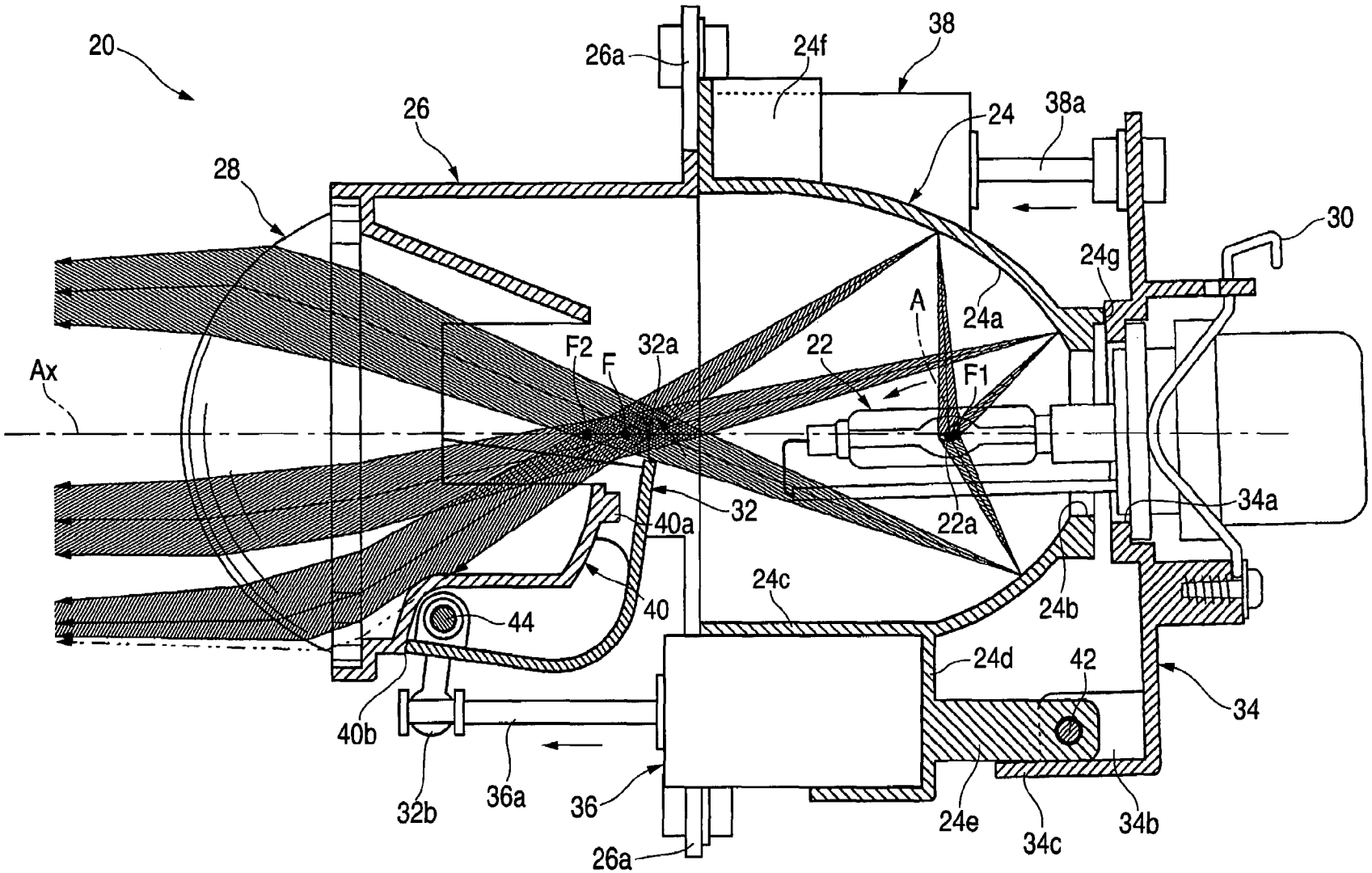
FIG. 7 is a side sectional view showing an optical path resulting when the light source is located at the second position thereof and the movable shade is located at the second position thereof.

FIG. 4 is a drawing which shows an optical path resulting when the light source 22*a* is located at the first light source position and the movable shade 32 is located at the first shade position, FIG. 5 is a drawing which shows an optical path resulting when the light source 22*a* is located at the second light source position and the movable shade 32 is located at the first shade position, FIG. 6 is a drawing which shows an optical path resulting when the light source 22*a* is located at the first light source position and the movable shade 32 is located at the second shade position, and FIG. 7 is a drawing which shows an optical path resulting when the light source 22*a* is located at the second light source position and the movable shade 32 is located at the second shade position.

As shown in FIGS. 4 and 5, when the movable shade 32 is located at the first shade position, reflected light from the reflector 24 is partially intercepted by the movable shade 32 whether the light source 22*a* is located either of the first and second light source positions, and the remaining portion of the reflected light is incident on the projection lens 28. In contrast, as shown in FIGS. 6 and 7, when the movable shade 32 is located at the second shade position, the reflected light from the reflector 24 is substantially totally incident on the projection lens 28 without being intercepted by the movable shade 32.

In addition, as is shown in these figures, whether the movable shade 32 is located at either of the first and second shade positions, the degree at which reflected light from the reflector 24 is collected on the rear focal point plane of the projection lens 28 is made higher when the light source 22*a* is located at the second light source position than when the light source 22*a* is located at the first light source position.

FIGS. 8A to 9B are perspective views of light distribution patterns which are formed on an imaginary perpendicular screen disposed at a distance of 25 m in front of the lamp by light emitted forward from the vehicle headlamp 10.

Figure 8A:
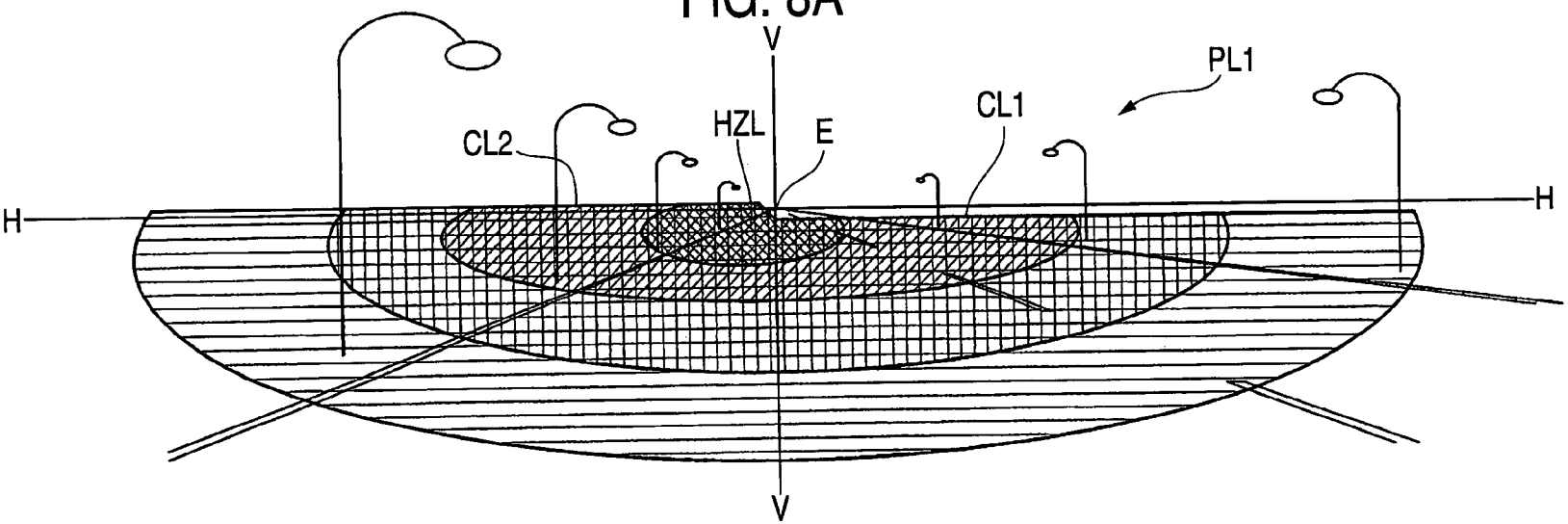
FIG. 8A is a perspective view of a low beam light distribution pattern formed on an imaginary perpendicular screen disposed at a distance of 25 m ahead of the lamp unit by light emitted forward from the vehicle headlamp, and showing a low beam light distribution pattern resulting when the light source is located at the first light source position and the movable shade is located at the first shade position.
Figure 8B:
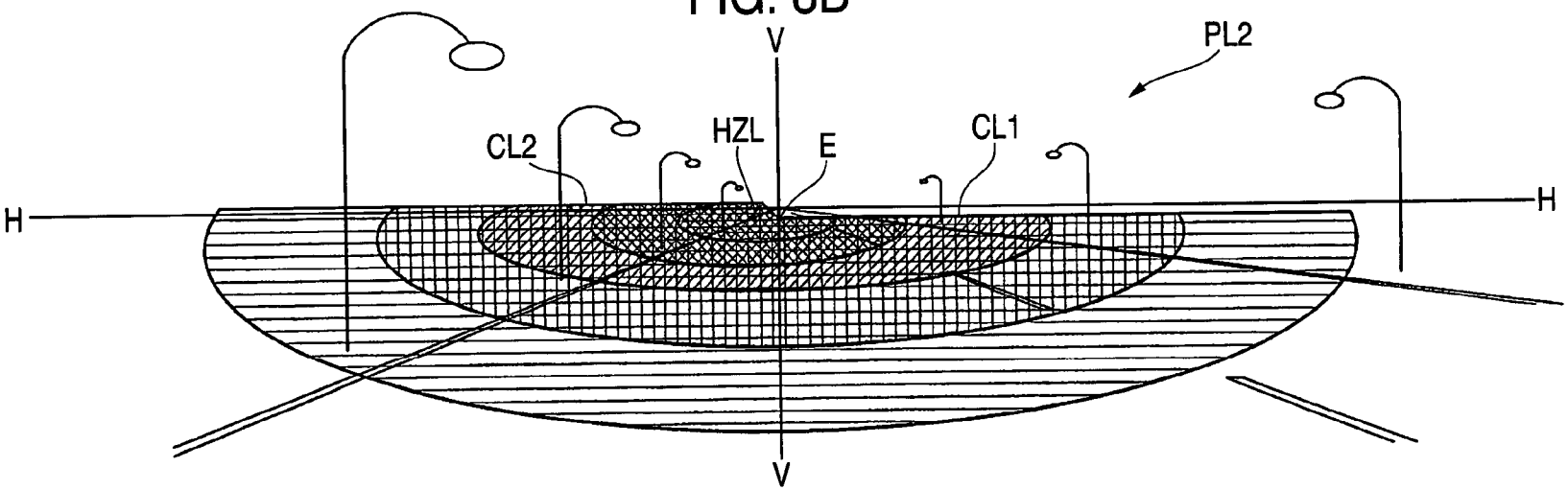
FIG. 8B is a perspective view of a low beam light distribution pattern formed on an imaginary perpendicular screen disposed at a distance of 25 m ahead of the lamp unit by light emitted forward from the vehicle headlamp, and showing a low beam light distribution pattern resulting when the light source is located at the second light source position and the movable shade is located at the first shade position.

A light distribution pattern PL1 shown in FIG. 8A is a low beam light distribution pattern which is to be formed when the light source 22*a* is located at the first light source position and the movable shade 32 is located at the first shade position, and a light distribution pattern PL2 shown in FIG. 8B is a low beam light distribution pattern which is to be formed when the light source 22*a* is located at the second light source position and the movable shade 32 is located at the first shade position.

Figure 9A:
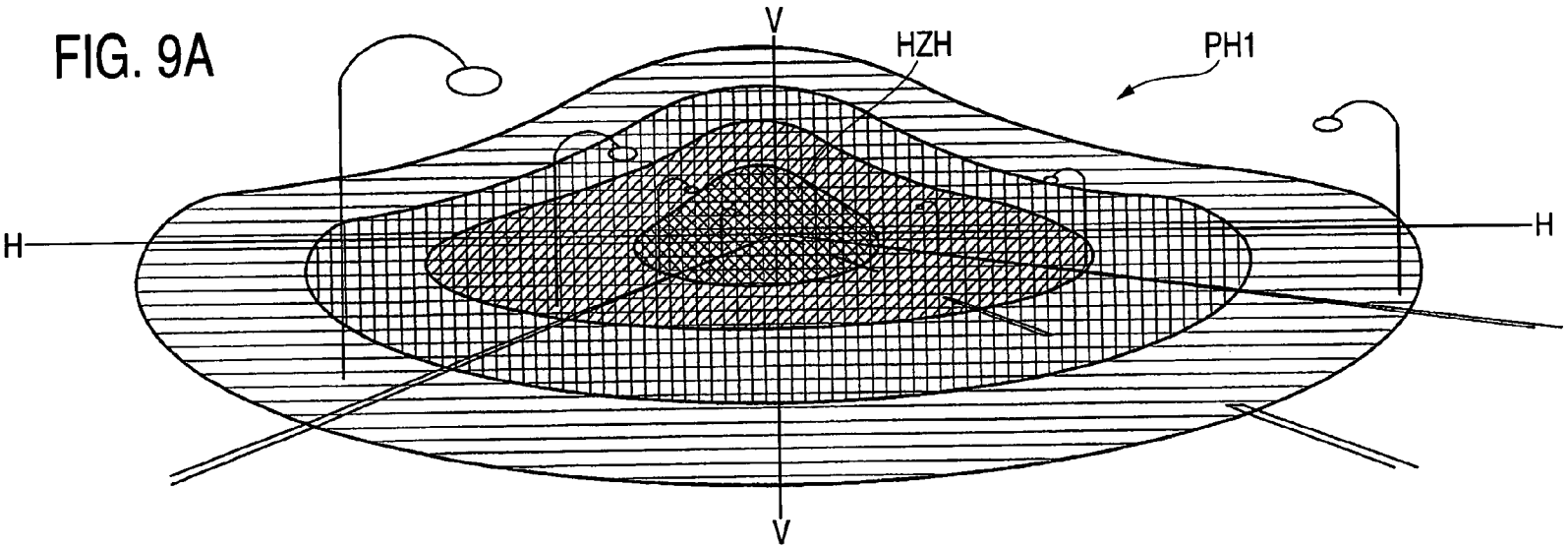
FIG. 9A is a perspective view of a high beam light distribution pattern formed on the imaginary perpendicular screen by light emitted forward from the vehicle headlamp, and showing a high beam light distribution pattern resulting when the light source is located at the first light source position and the movable shade is located at the second shade position.
Figure 9B:
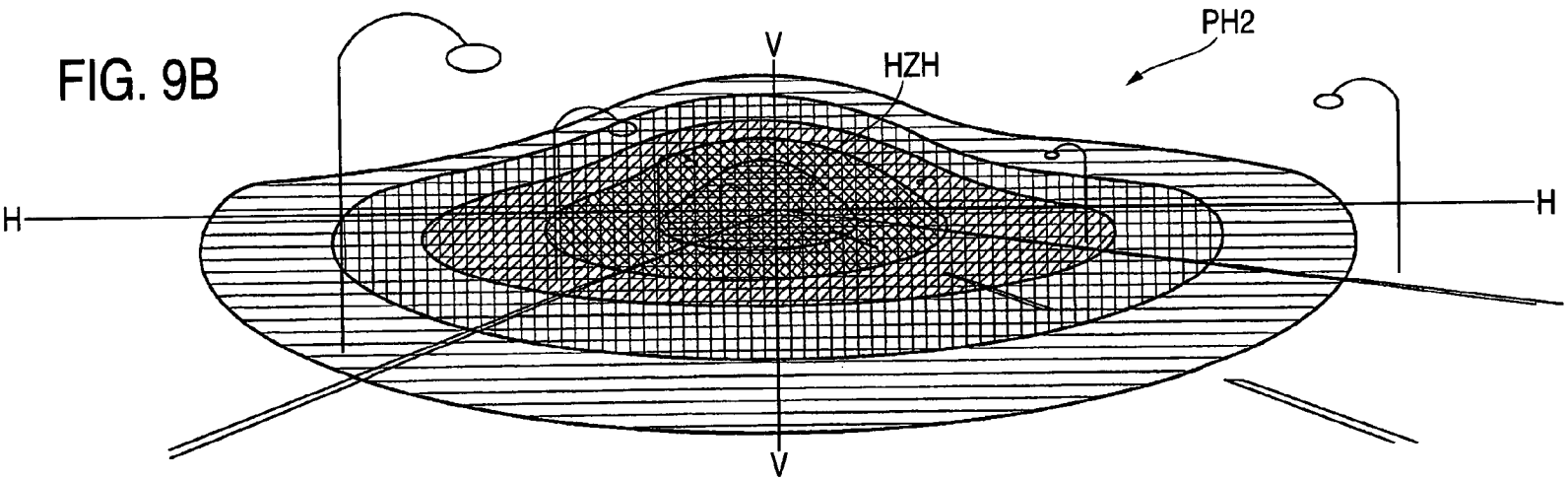
FIG. 9B is a perspective view of a high beam light distribution pattern formed on the imaginary perpendicular screen by light emitted forward from the vehicle headlamp, and showing a high beam light distribution pattern resulting when the light source is located at the second light source position and the movable shade is located at the second shade position.

A light distribution pattern PH1 shown in FIG. 9A is a high beam light distribution pattern which is to be formed when the light source 22*a* is located at the first light source position and the movable shade 32 is located at the second shade position, and a light distribution pattern PH2 shown in FIG. 9B is a high beam light distribution pattern which is to be formed when the light source 22*a* is located at the second light source position and the movable shade 32 is located at the second shade position.

The low beam light distribution pattern PL1 shown in FIG. 8A is a low beam light distribution pattern designed for a left-hand side traffic in which vehicles are driven on the left-hand side of the road and has transversely stepped cut-off lines CL1, CL2 along an upper end edge thereof. The cut-off lines CL1, CL2 extend horizontally at different levels which are transversely stepped up or down from each other across a boundary constituted by a V-V line which passes perpendicularly through an H-V point which is a vanishing point in a forward direction of the lamp, wherein a portion situated rightward of the line V-V, which constitutes an on-coming vehicle lane portion, is formed as the lower cut-off line CL1, whereas a portion situated leftward of the line V-V, which constitutes a subject vehicle lane portion, is formed as the upper cut-off line CL2 which is stepped upward from the lower cut-off line CL1 via a slope portion. In this low beam light distribution pattern PL1, the position of an elbow point E which is an intersection point between the lower cut-off line CL2 and the line V-V is set at a position located on the order of 0.5 to 0.6° further downward than the H-V point, and a hot zone HZL, which is a high luminous intensity area, is formed in such a manner as to include the elbow point E in a slightly leftward area of the hot zone HZL.

This low beam light distribution pattern PL1 is formed by projecting an image of the light source 22*a* formed on the rear focal plane of the projection lens 28 by light from the light source 22*a* which is reflected on the reflecting surface 24*a* of the reflector 24 on to the imaginary perpendicular screen as an inverted projection image by the projection lens 28, and the cut-off lines CL1, CL2 thereof are formed as an inverted projection image of the upper end edge 32*a* of the movable shade 32.

The low beam light distribution pattern PL2 shown in FIG. 8B is totally identical to the low beam light distribution pattern PL1 with respect to cut-off lines CL1, CL2 thereof, but an overall diffusion angle thereof becomes slightly smaller than that of the low beam light distribution pattern PL1 and a hot zone HZL thereof becomes brighter than that of the low beam light distribution pattern PL1. This is because the degree at which reflected light from the reflector 24 is collected on the rear focal plane of the projection lens 28 is made higher when the light source 22*a* is situated at the second light source position than when at the first light source position.

The high beam light distribution pattern PH1 shown in FIG. 9A has a shape resulting when the low beam light distribution pattern PL1 is expanded as far as an area above the cut-off lines CL1, CL2 thereof and a hot zone HZH is formed about the H-V point. This is because the interception of the reflected light from the reflector 24 by the movable shade 32 is released by virtue of the moving of the movable shade 32 from the first shade position to the second shade position.

The high beam light distribution pattern PH2 shown in FIG. 9B has a shape resulting when the low beam light distribution pattern PL2 is expanded as far as an area above the cut-off lines CL1, CL2 thereof. An overall diffusion angle of the high beam light distribution pattern PH2 becomes slightly smaller than that of the high beam light distribution pattern PH1 and a hot zone HZL thereof becomes brighter than that of the high beam light distribution pattern PH1.

Thus, as has been described heretofore, while in the vehicle headlamp 10 according to the embodiment, the lamp unit 20 is configured as the projector type lamp unit with the movable shade 32, since the movable shade 32 is made to be moved by the shade driving device 36 between the first shade position where the upper end edge 32*a* is positioned on the optical axis Ax at the rear focal point F of the projection lens 28 and the second shade position where the position of the upper end edge 32*a* is located further downward than the position thereof resulting when the movable shade 32 is located at the first shade position, although the light source 22*a* is single, the low beam light distribution patterns PL1, PL2 and the high beam light distribution patterns PH1, PH2 can selectively formed.

Moreover, in the vehicle headlamp 10 according to the embodiment, since the light source 22*a* is made to be moved by the light source driving device 38 between the first light source position which is positioned on the optical axis Ax and the second light source position which is positioned further forward than the first light source position, the four types of light distribution patterns can be formed through the combinations of the positions of the light source 22*a* and the positions of the movable shade 32.

Namely, since when the light source 22*a* is located at the first light source position and the movable shade 32 is located at the first shade position, part of the reflected light from the reflector 24 is intercepted by the movable shade 32, the low beam light distribution pattern PL1 can be obtained which has the cut-off lines CL1, CL2 as the inverted image of the upper end edge 32*a* of the movable shade 32. Then, since, in case the movable shade 32 is moved to the second shade position from this state, the interception of the reflected light by the movable shade 32 is released, light is then allowed to illuminate as far as above the cut-off lines CL1, CL2, whereby the high beam light distribution pattern PH1 can be obtained.

On the other hand, the degree at which reflected light from the reflector 24 is collected on the rear focal plane of the projection lens 28 can be increased in the event that the light source 22*a* is moved to the second light source position from such a state that the light source 22*a* is located at the first light source position and the movable shade 32 is located at the first shade position. Then, by realizing this, the low beam light distribution pattern PH2 can be obtained which has the smaller overall diffusion angle and the higher center luminous intensity than the low beam light distribution pattern PL1 while maintaining a light distribution pattern shape having cut-off lines CL1, CL2 at an upper end portion as with the low beam light distribution pattern PL1.

In addition, since light is allowed to illuminate as far as above the cut-off lines CL1, CL2 in such a state that the degree at which reflected light from the reflector 24 is collected on the rear focal plane of the projection lens 28 is increased in the event that the light source 22*a* is moved to the second light source position and the movable shade 32 is moved to the second shade position from such a state that the light source 22*a* is located at the first light source position and the movable shade 32 is located at the first shade position, the high beam light distribution pattern PH2 can be obtained which has the smaller overall diffusion angle and the higher center luminous intensity than the high beam light distribution pattern PH1 light distribution pattern.

Then, in the event that any of these four types of light distribution patterns PL1, PL2, PH1, PH2 is made to be selected appropriately according to the driving condition of the vehicle, the safety and comfortableness can be increased while driving at night.

Namely, in the event that, of the low beam light distribution patterns, the low beam light distribution pattern PL1, which can illuminate widely the near field area in front of the vehicle, is selected when driving in an urban area or the like, whereas the low beam light distribution patter PL2, which is superior in visibility in the far field area in front of the vehicle, is selected when driving at high speeds or the like, the safety and comfortableness can be increased when driving at night with the low beam.

In addition, in the event that, of the high beam light distribution patterns, the high beam light distribution pattern PH1, which can illuminate widely in the near field in front of the vehicle, is selected when driving on a curved road in a mountainous area or the like, whereas the high beam light distribution pattern PH2, which is superior in visibility in the far field in front of the vehicle, is selected when driving on a rectilinear roadway at high speeds or the like, the safety and comfortableness can be increased when driving at night with the high beam.

As this occurs, while the changeover among the low beam light distribution patterns PL1, PL2 and the high beam light distribution patterns PH1, PH2 is implemented by driving the shade driving device 36 through the operation of a beam changeover switch, not shown, since the changeover between the low beam light distribution pattern PL1 and the low beam light distribution pattern PL2 and the changeover between the high beam light distribution pattern PH1 and the high beam light distribution pattern PH2 are implemented by driving the light source driving device 38 by a drive signal from a drive control unit, not shown, in the event that this drive control unit is activated manually or automatically according to the driving condition of the vehicle, an optimal light distribution pattern can be selected.

Thus, according to the embodiment of the invention, in the projector type vehicle headlamp 10 with the movable shade 32, an appropriate light distribution pattern can be formed even when the movable shade 32 is moved to either of its positions.

As this occurs, in the vehicle headlamp 10 according to the embodiment, since the reflecting surface 24*a* of the reflector 24 has the oval perpendicular cross section which takes, as the first focal point, the first light source position and, as the second focal point, the point which is located further forward than the rear focal point F on the optical axis Ax, the following function and advantage can be obtained.

Namely, by setting the shape of the perpendicular cross section of the reflecting surface 24*a* of the reflector 24 to the oval shape and setting the second focal point F2 thereof at the position further forward than the rear focal point F of the projection lens 28, the degree at which reflected light from the reflector 24 is collected on the rear focal plane of the projection lens 28 can be mitigated when compared with a case where the second focal point F2 is set at the rear focal point F of the projection lens 28, whereby the low beam light distribution pattern PL1 and the high beam light distribution pattern PH1 can be made a light distribution pattern having a relatively large diffusion angle. On the other hand, since the convergence position of reflected light from the reflector 24 is shifted from the second focal point F2 to the position that is further rearward than the same focal point F2 when the light source 22*a* is moved forward from the first focal point F1, by setting the second focal point F2 at the position which is further forward than the rear focal point F of the projection lens 28, the degree at which reflected light from the reflector 24 is collected on the rear focal plane of the projection lens 28 can be increased which results when the light source 22*a* is moved to the second light source position, whereby it is possible to obtain in an ensured fashion the low beam light distribution pattern PH2 and the high beam light distribution pattern PH2 which have the smaller overall diffusion angle and the higher center luminous intensity than the low beam light distribution pattern PL1 and the high beam light distribution pattern PH1.

In addition, in the vehicle headlamp 10 according to the embodiment, since the second light source position is set at the position which is forward and below relative to the first light source position, when compared with a case where the second light source position is set at the position which is at the same height as and further forward than the first light source position, the position where reflected light from the reflector 24 is incident on the rear focal plane of the projection lens 28 can be made to deviate upward, whereby since the interception quantity of reflected light from the reflector 24 by the movable shade 32 can be kept small, the luminous flux of the light source 22*a* can be utilized effectively, thereby making it possible to make the low beam light distribution pattern PL2 brighter.

Next, an modified example of the first embodiment will be described.

Figure 10:
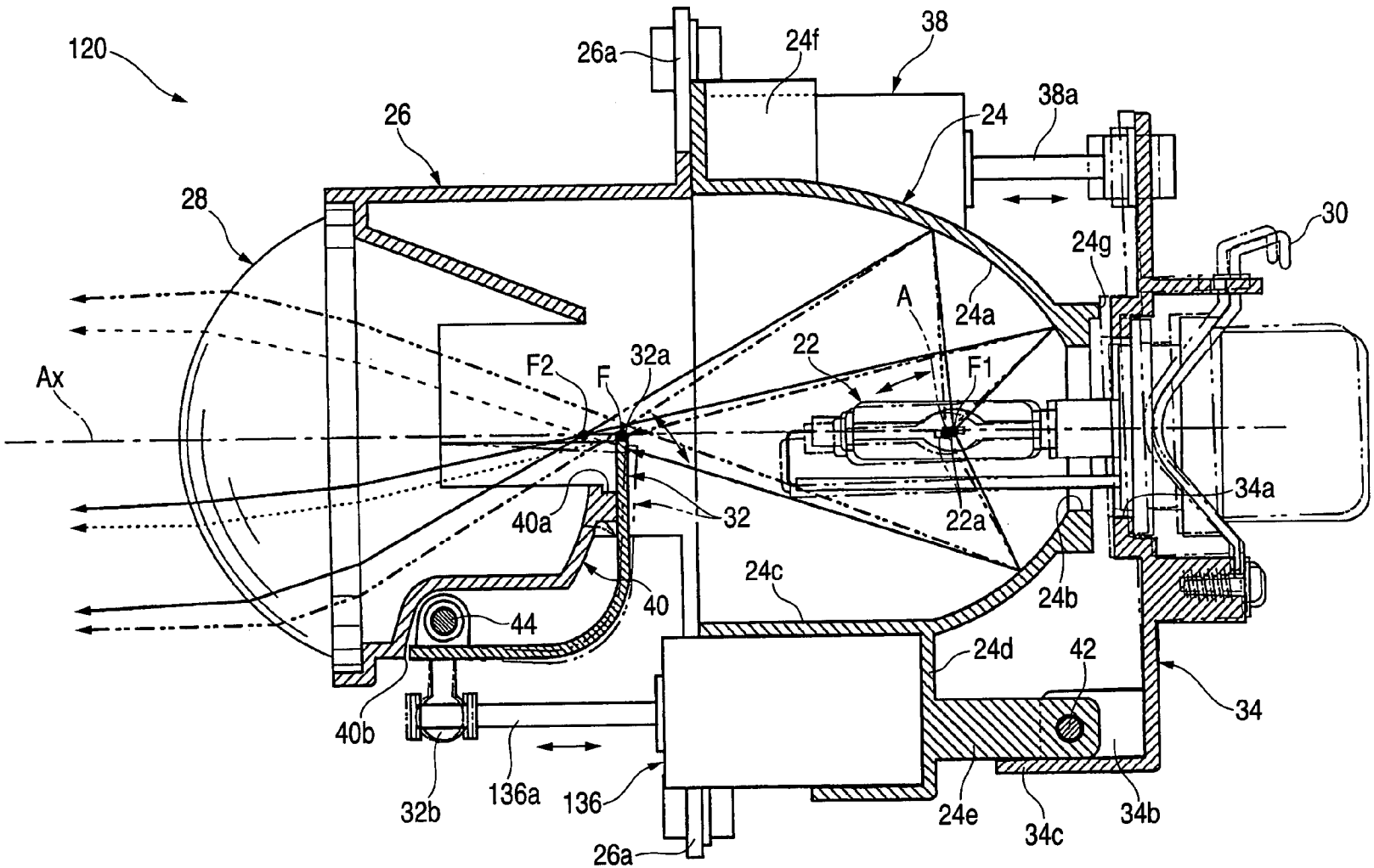
FIG. 10 is a drawing similar to FIG. 2, which shows a lamp unit according to a modified example of one or more embodiments of the invention.

FIG. 10 is a similar drawing to FIG. 2, which shows a lamp unit 120 according to the modified example. As shown in the figure, while the lamp unit 120 is similar to the lamp unit 20 according to the embodiment with respect to a basic configuration thereof, the configuration of a shade driving device 136 differs from the corresponding unit of the aforesaid embodiment.

Namely, while the shade driving device 136 of the modified example is similar to the shade driving device 36 of the embodiment in that the former shade driving device has also a plunger 136*a* which extends forward, the forward traveling distance of the plunger 136*a* is set to a smaller value than that of the shade driving device 36 of the embodiment, whereby the second shade position of the movable shade 32 which results when the plunger 136*a* is driven forward is set at a position closer to the first shade position than the second shade position of the embodiment. To be specific, the second shade position according to the modified example is set at a position which is 0.3 to 0.4 mm further downward than the first shade position. In addition, as with the shade driving device 36 of the embodiment, the shade driving device 136 of the modified example is made to be driven by a beam changeover switch, not shown.

Figure 11A:
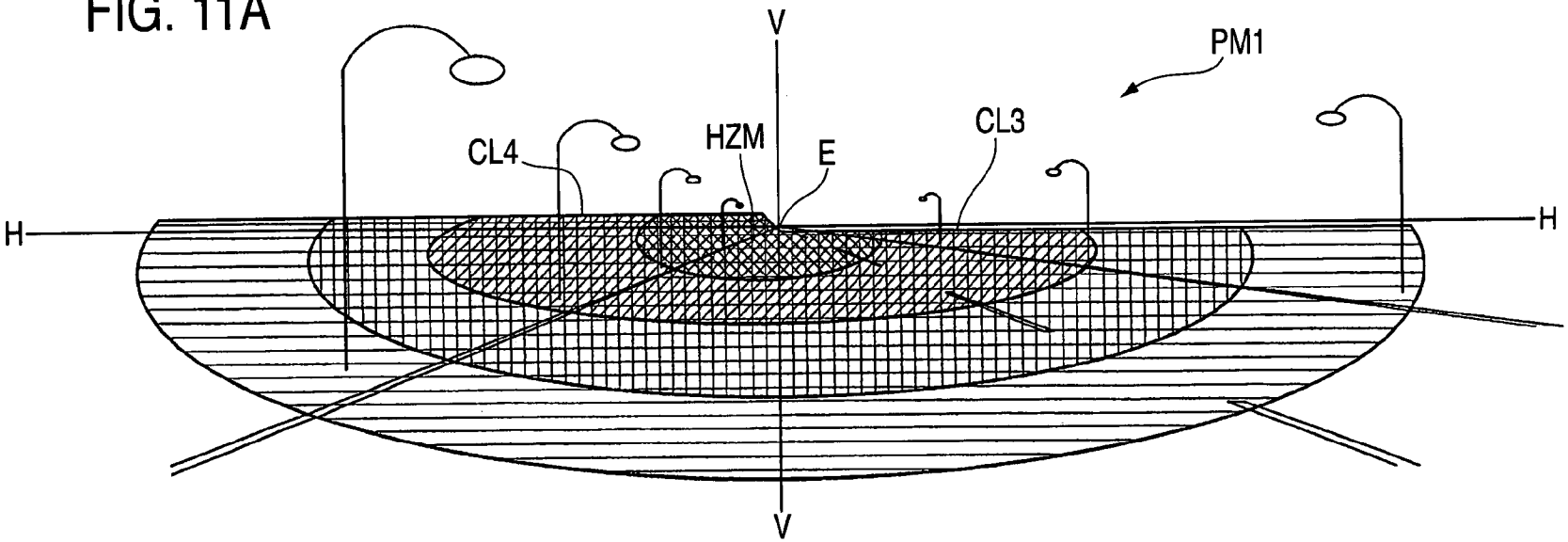
FIG. 11A is a perspective view of an intermediate light distribution pattern formed on the imaginary perpendicular screen by light emitted forward from the vehicle headlamp, and showing an intermediate light distribution pattern resulting when the light source is located at the first light source position and the movable shade is located at the second shade position.
Figure 11B:
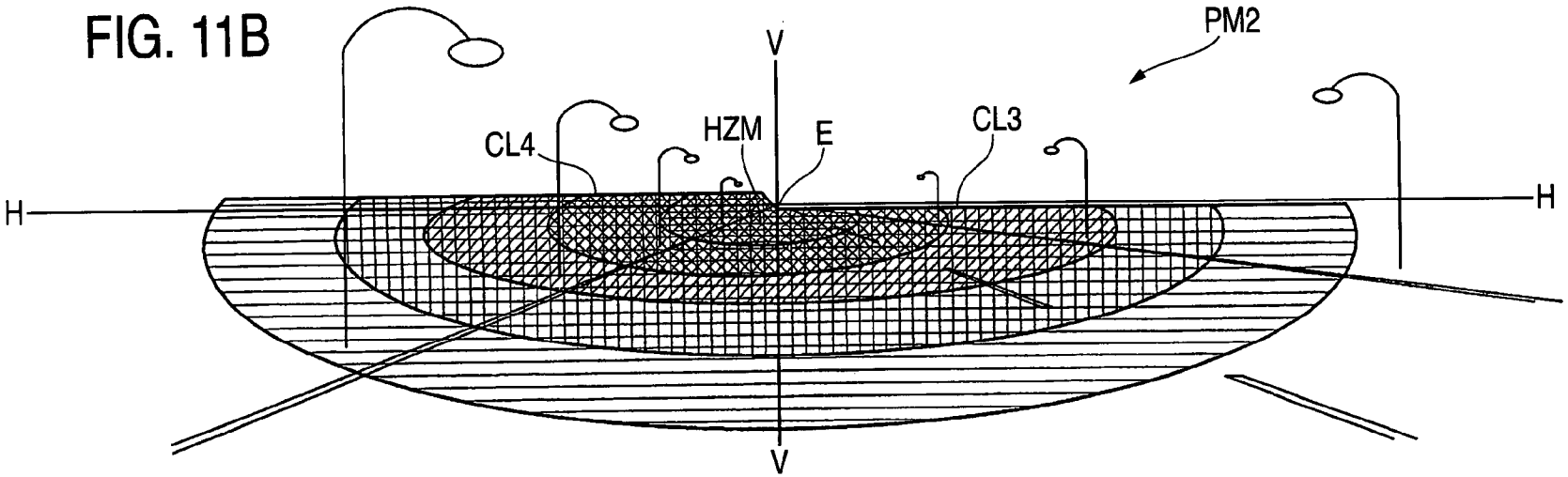
FIG. 11B is a perspective view of an intermediate light distribution pattern formed on the imaginary perpendicular screen by light emitted forward from the vehicle headlamp, and showing an intermediate light distribution pattern resulting when the light source is located at the second light source position and the movable shade is located at the second shade position.

FIGS. 11A and 11B is a perspective view showing a light distribution pattern that is to be formed on the imaginary perpendicular screen disposed at a distance of 25 m in front of the lamp by light reflected forward from a vehicle headlamp provided with the lamp unit 120 according to the modified example.

A light distribution pattern PM1 shown in FIG. 11A is an intermediate light distribution pattern that is to be formed when the light source 22*a* is located at the first light source position and the movable shade 32 is located at the second shade position, and a light distribution pattern PM2 shown in FIG. 11B is an intermediate light distribution pattern that is to be formed when the light source 22*a* is located at the second light source position and the movable shade 32 is located at the second shade position.

Note that a low beam light distribution pattern that is to be formed when the light source 22*a* is located at the first light source position and the movable shade 32 is located at the first shade position and a low beam light distribution pattern that is to be formed when the light source 22*a* is located at the second light source position and the movable shade 32 is located at the first shade position are totally identical to those of the embodiment.

The intermediate light distribution pattern PM1 shown in FIG. 11A has a shape which results when the low beam light distribution pattern PL1 is expanded slightly upward.

Namely, this intermediate light distribution pattern PM1 has cut-off lines CL3, CL4 at an upper end portion thereof, and a hot zone HZM is formed in such a manner as to include an elbow point E thereof in a slightly leftward area thereof. The cut-off lines CL3, CL4 of this intermediate light distribution point PM1 are positioned slightly (to be specific, on the order of 0.34°) further upward than the cut-off lines CL1, CL2 of the low beam light distribution pattern PL1. In addition, the hot zone HZM of this intermediate light distribution pattern PM1 has a shape which results when the hot zone HZL of the low beam light distribution pattern PL1 is expanded upward as far as the positions of the cut-off lines CL3, CL4.

While the intermediate light distribution pattern PM2 shown in FIG. 11B is totally identical to the intermediate light distribution pattern PM1 with respect to the positions of cut-off lines CL3, CL4 thereof, an overall diffusion angle thereof is slightly smaller than that of the intermediate light distribution pattern PM1 and the hot zone HZM is made brighter than that of the intermediate light distribution pattern PM1. This is because the degree at which reflected light from the reflector 24 is collected on the rear focal plane of the projection lens 28 is made higher when the light source 22*a* is located at the first light source position than when at the second light source position.

When adopting the lamp unit 120 of the modified example, although there is only the single light source 22*a*, the low beam light distribution patterns PL1, PL2 and the intermediate light distribution points PM1, PM2 can selectively be formed by moving the movable shade 32 between the first shade position and the second shade position thereof.

Namely, while the low beam light distribution pattern PL1 can be obtained when the light source 22*a* is located at the first light source position and the movable shade 32 is located at the first shade position, in the event that the movable shade 32 is moved to the second shade position from this state, since the interception of the reflected light from the reflector by the movable shade 32 is slightly mitigated, the intermediate light distribution pattern PM1 can be obtained which is suitable for high speed driving and driving in a mountainous area.

Since the hot zone HZM of the intermediate light distribution pattern PM1 is expanded upward relative to the hot zone HZL of the low beam light distribution pattern PL1, the visibility in the far field area on the road surface in front of the vehicle can be increased. As this occurs, however, since the interception of the reflected light from the reflector by the movable shade 32 is not totally released but is released to such an extent that the cut-off lines CL3, CL4 remain, it is possible to prevent an oncoming vehicle driver or the like from being dazzled greatly by glare that would other be provided by the lamp unit.

On the other hand, while the low beam light distribution pattern PL2 having a smaller overall diffusion angle and a higher center luminous intensity than those of the low beam light distribution pattern PL1 can be obtained when the light source 22*a* is located at the second light source position and the movable shade 32 is located at the first shade position, in the event that the movable shade 32 is moved to the second shade position from this state, since the interception by the movable shade 32 is mitigated slightly in such a state that the degree at which reflected light from the reflector 24 is collected on the rear focal plane of the projection lens 28 is increased, it is possible to obtain the intermediate light distribution pattern PM2 of which the overall diffusion angle is smaller and the center luminous intensity is higher than those of the intermediate light distribution pattern PM1, and the light distribution pattern so obtained can be made suitable for high speed driving.

Then, in the event that any of these four types of light distribution patterns PL1, PL2, PM1, PM2 is made to be selected appropriately according to the driving condition of the vehicle, the safety and comfortableness can be increased during driving at night.

In addition, in the embodiment and the modified example therefrom, while the lamp units 20, 120 are configured so as to form low beam light distribution patterns for the left-hand side traffic in which vehicles are driven on the left-hand side of the road as the low beam light distribution patterns PL1, PL2, the same functions and advantages as those provided by the light distribution patterns for the left-hand side traffic can be obtained by adopting the same configurations as those of the embodiment and the modified example even in the event that the lamp units 20, 120 are attempted to be configured so as to form low beam light distribution patterns for a right-hand side traffic in which vehicles are driven on the right-hand side of the road.

Figure 12:
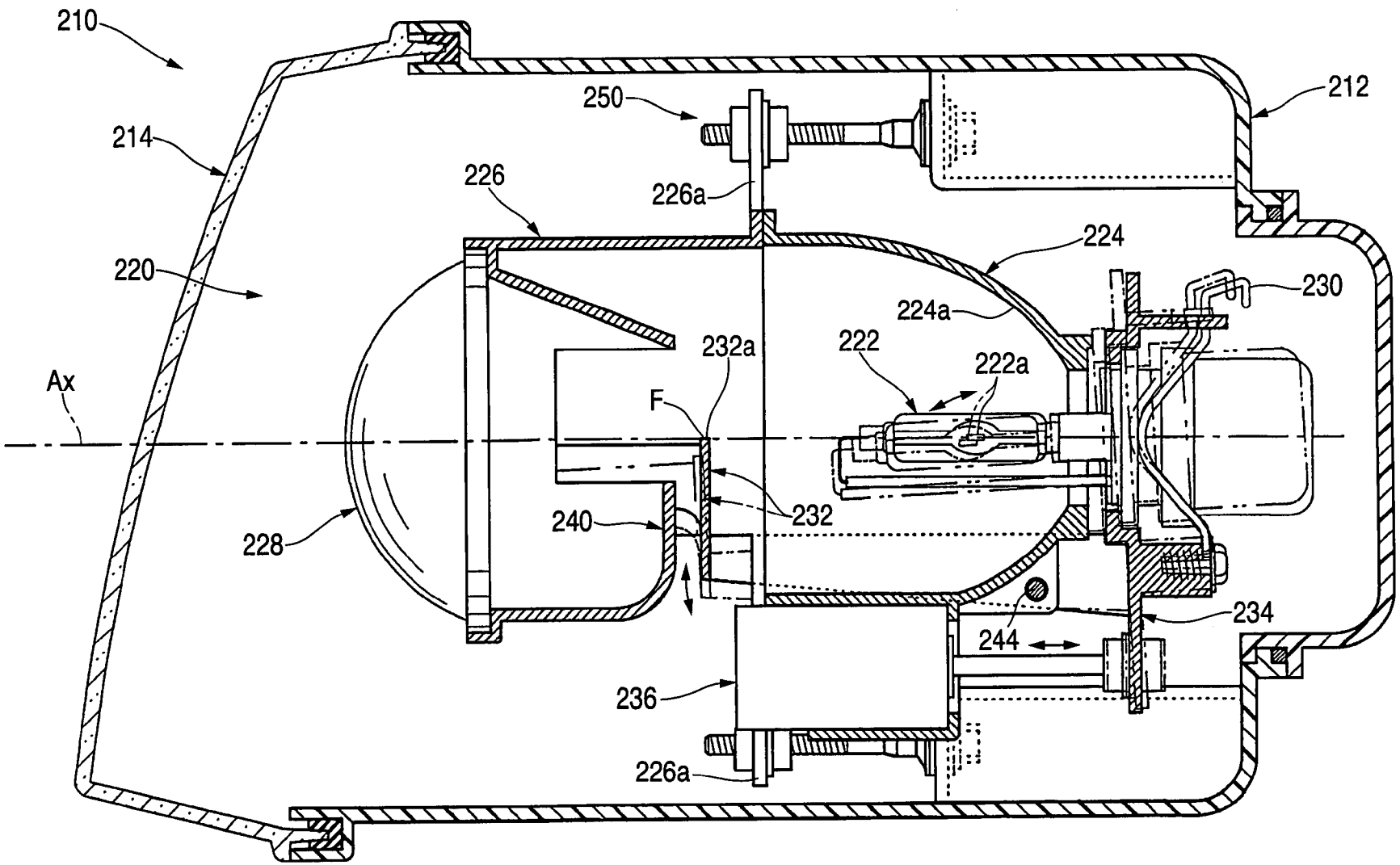
FIG. 12 is a side sectional view showing a vehicle headlamp according to one or more embodiments of the invention.

FIG. 12 is a side sectional view of a vehicle headlamp 210 according to second embodiment of the invention.

As shown in the FIG. 12, the vehicle headlamp 210 is constructed such that a lamp unit 220 having an optical axis Ax which extends in a longitudinal direction of a vehicle is accommodated within a lamp compartment which is defined by a lamp body 212 and a transparent, light transmitting cover 214 which is mounted over a front end opening of the lamp body 212 via an aiming mechanism 250 in such a manner as to be tilted vertically and horizontally.

Then, in the vehicle headlamp 210, at a stage where the aiming adjustment by the aiming mechanism 250 is completed, the optical axis Ax of the lamp unit 220 is made to extend on the order of 0.5 to 0.6° downwards relative to the longitudinal direction of the vehicle.

Figure 13:
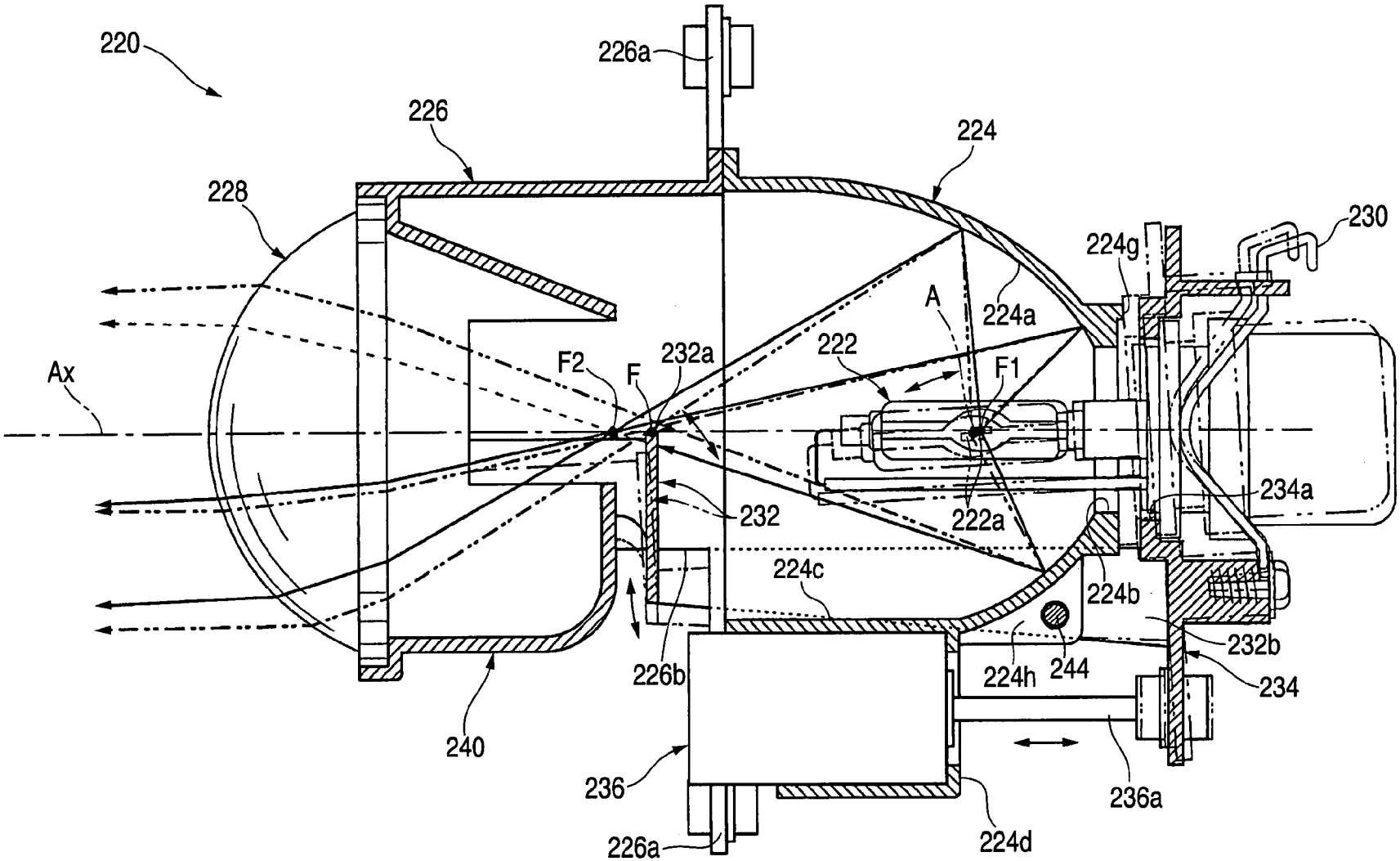
FIG. 13 is a side sectional view showing a lamp unit of the vehicle headlamp singly.
Figure 14:
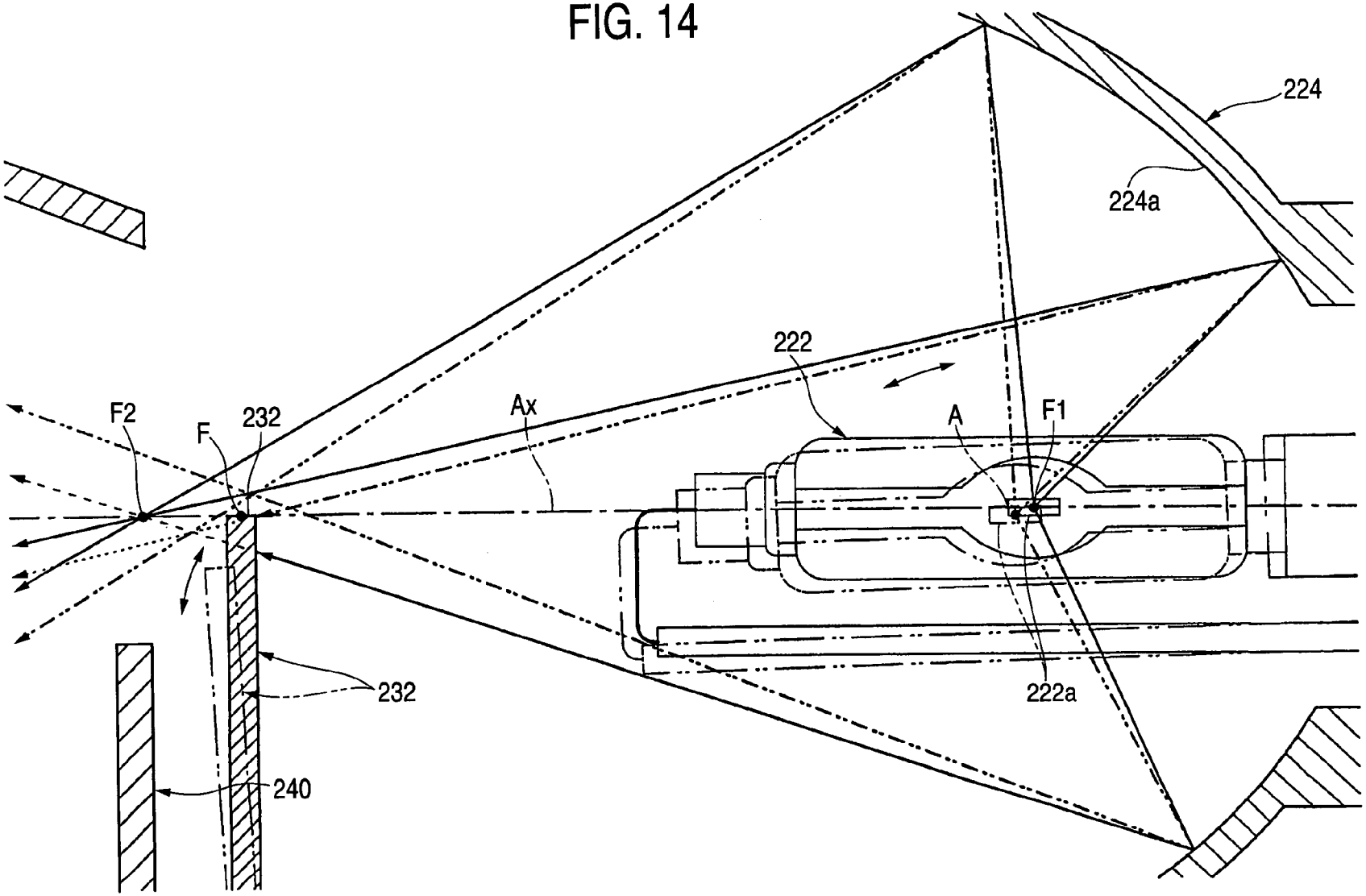
FIG. 14 is a detailed drawing of a main part of FIG. 13.

FIG. 13 is a side sectional view showing the lamp unit 320 singly, and FIG. 14 is a detailed view of a main part of FIG. 13.

Also as shown in FIGS. 13 and 14, the lamp unit 220 is a projector type lamp unit and includes a light source bulb 222, a reflector 224, a holder 226, a projection lens 228, a movable shade 232, a bulb support base 234, and a driving device 236.

The projection lens 228 is made up of a planoconvex lens with a front side surface convex and a back side surface plane and is disposed on the optical axis. Then, this projection lens 228 is made to project forward, as an inverted image, an image on a rear focal plane thereof which includes the rear focal point F.

The light source bulb 222 is a discharge bulb such as a metal halide bulb in which a discharge light emitting portion constitutes a light source 222*a* and is then inserted in a rear apex opening 224*d* of the reflector 224 from the rear in such a state that the light source bulb 222 is securely inserted in a bulb inserting and attaching portion 234*a* of the bulb support base 234 which is disposed in the vicinity of the rear of the rear apex opening 224*b* of the reflector 224 and is then fixed in place by means of a wire spring 230. The light source 222*a* of the light source bulb 222 is disposed further rearward than the rear focal point F of the projection lens 228 and is disposed in such a manner as to extend along the optical axis Ax on the same optical axis Ax when it is located at a first light source position, which will be described later.

The reflector 224 is made to reflect light from the light source 222*a* forward in such a manner that light so reflected approaches the optical axis Ax. A reflecting surface 224*a* of the reflector 224 is set such that a cross section thereof which includes the optical axis Ax becomes an oval shape which takes the center of the light source on the optical axis Ax as a first focal point F1 and that the eccentricity thereof gradually increases from a perpendicular section toward a horizontal section thereof. In this case, a second focal point F2 of the oval which constitutes the perpendicular section which includes the optical axis Ax is set at a position which is located slightly further forward than the rear focal point F of the projection lens 228. Then, by this configuration, the reflector 224 is made to make light from the light source 222*a* which has been reflected on the reflecting surface 224*a* substantially converge at the second focal point F2 within the perpendicular cross section and is made to shift the convergence position rather forward within the horizontal section.

The holder 226 is formed in such a manner as to extend forward from the front end opening of the reflector 224 in a substantially cylindrical fashion and fixedly supports the reflector 224 and the projection lens 228 at a rear end portion and a front end portion, respectively. The holder 226 is cut away at a lower area thereof. In addition, a plurality of aiming brackets 226*a* are formed along a rear end circumferential edge portion for connecting the lamp unit 220 to the aiming mechanism 250.

The movable shade 232 is provided in such a manner as to be positioned substantially in a lower half portion in an interior space of the holder 226. This movable shade 232 has a pair of left and right stays 232*b* which are formed at a lower end portion of the movable shade 232 in such a manner as to extend to the rear and is fixedly supported by the bulb support base 234 at distal end portions of both the stays 232*b*. Then, this movable shade 232, together with the bulb support base 234, is rotatably supported on the reflector 224 via a rotational pin 244 which extends transversely at a location thereof which is in the vicinity of both the stays 232*b*. This rotational pin 244 is disposed at a position which is situated on the order of 10 to 30° further rearward relative to a perpendicular downward direction of the light source 222*a* and is rotatably inserted in a pair of left and right tabs 224*h* formed in the vicinity of the rear of a unit mount portion 224*d* on the reflector 224 so as to be supported therein.

This movable shade 232 is made to take a first shade position which is indicated by solid lines in FIGS. 13 and 14 and a second shade position which results when the movable shade 232 is rotated a predetermined angle downward from the first shade position and which is indicated by double-dashed lines in FIGS. 13 and 14.

An upper end edge 232*a* of the movable shade 232 is formed in such a manner as to be stepped transversely or to form a transverse step and extends horizontally in an arc-like fashion. Then, this upper end edge 232*a* is disposed in such a manner as to pass through the rear focal point F of the projection lens 228 to thereafter extend along the rear focal point plane thereof when the movable shade 232 is located at the first shade position, whereas when the movable shade 232 is moved to the second shade position, the upper end edge 232*a* is disposed further forward and obliquely downward than its position resulting when the movable shade 232 is located at the first shade position. Then, when at the second shade position, the upper end edge 232*a* of the movable shade 232 is made to be located on the order of 4 mm further downward than its position resulting when the movable shade 232 is located at the first shade position.

A stationary shade 240 is formed integrally with the holder 226 in front of the movable shade 232 for preventing stray light that has been reflected on the reflector 224 from being incident on the projection lens 228.

The light source 222*a* is made to take, by virtue of the rotation of the bulb support member 234, a first light source position where the center of the light source 222*a* is positioned at the first focal point F1 and a second light source position where the center thereof is positioned at a point A which is further forward and slightly further downward than the first focal point F1. The specific position of the point A is set at a position which is on the order of 2 mm further forward and on the order of 0.5 mm further downward than the first focal point F1.

When the light source 222*a* is located at the first light source position, since the center of the light source 222*a* is located at the first focal point F1, light from the center of the light source 222*a* which is reflected on the reflector 224 intersects with the optical axis Ax at the second focal point F2 of the oval as indicated by solid lines in FIGS. 13 and 14. On the other hand, when the light source 222*a* is located at the second light source position, since the center of the light source 222*a* is located at the point A which is further forward and slightly further downward than the first focal point F1, light from the center of the light source 222*a* which is reflected on the reflector 224 intersects with the optical axis Ax at a point further rearward than the second focal point F2 as indicated by double-dashed lines in FIGS. 13 and 14.

As this occurs, since the second focal point F2 is located further forward than the rear focal point F of the projection lens 228, the degree at which reflected light from the reflector 224 is collected on the rear focal point plane of the projection lens 228 is made higher when the light source 222*a* is located at the first light source position than when the light source 222*a* is located at the second light source position. Moreover, since the second light source position is located not only further forward but also slightly further downward than the first light source position, a light collecting position on the rear focal point plane of the projection lens 228 is made to deviate slightly further upward than the optical axis Ax.

The driving device 236 is made up of a solenoid having a plunger 236*a* which extends rearward and is fixed to the unit mount portion 224*d* formed on a lower surface of a bottom wall 224*c* of the reflector 224. The plunger 236*a* of the driving device 236 is brought into engagement with a lower end portion of the bulb support base 234 at a distal end portion thereof, whereby a longitudinal reciprocating motion of the plunger 236*a* is made to be transmitted as a rotational motion of the bulb support base 234.

Then, this driving device 236 is made be driven when a beam changeover switch, not shown, is operated so as to drive the plunger 236*a* in the longitudinal direction, whereby the bulb support base 234 is made to be moved between a fist shift position where the light source 222*a* is located at the first light source position and the movable shade 232 is located at the first shade position and a second shift position where the light source 222*a* is located at the second light source position and the movable shade 232 is located at the second shade position.

As this occurs, when the bulb support base 234 is moved to the first shift position, upper end edges of both the stays 232*b* of the movable shade 232 are brought into abutment with a lower end face 226*b* of the cutaway portion of the holder 226 at front end portions thereof, whereby the movable shade 232 is positioned at the first shade position and the light source 222*a* is positioned at the first light source position, whereas when the bulb support member 234 is moved to the second shift position, the bulb support member 234 is brought into abutment with a positioning abutment portion 224*g* formed on an upper portion of the rear apex opening 224*b* of the reflector 224, whereby the movable shade 232 is positioned at the second shade position and the light source 222*a* is positioned at the second light source position.

Figure 15:
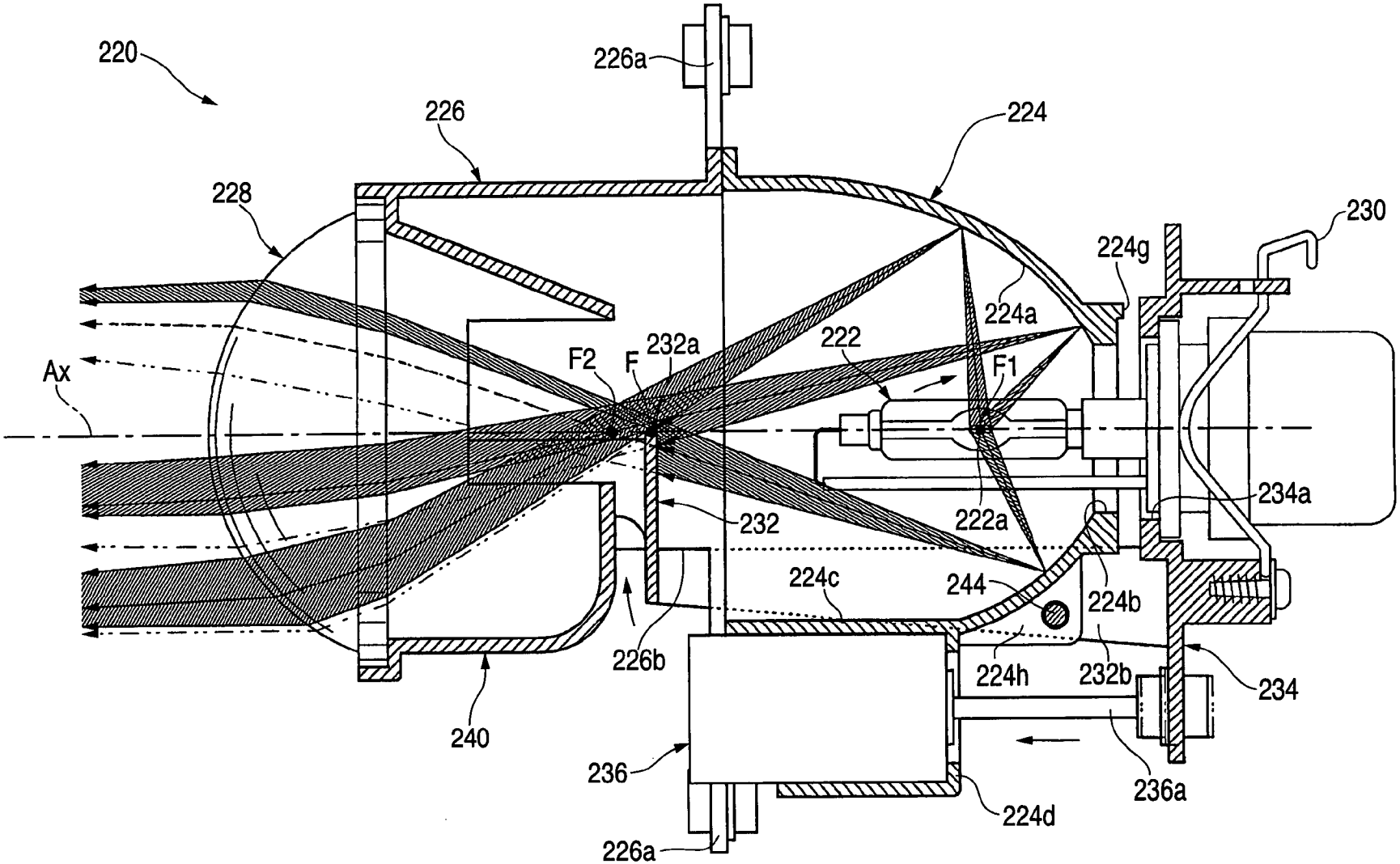
FIG. 15 is a side sectional view showing an optical path resulting when a bulb support base is located at a first shift position thereof.
Figure 16:
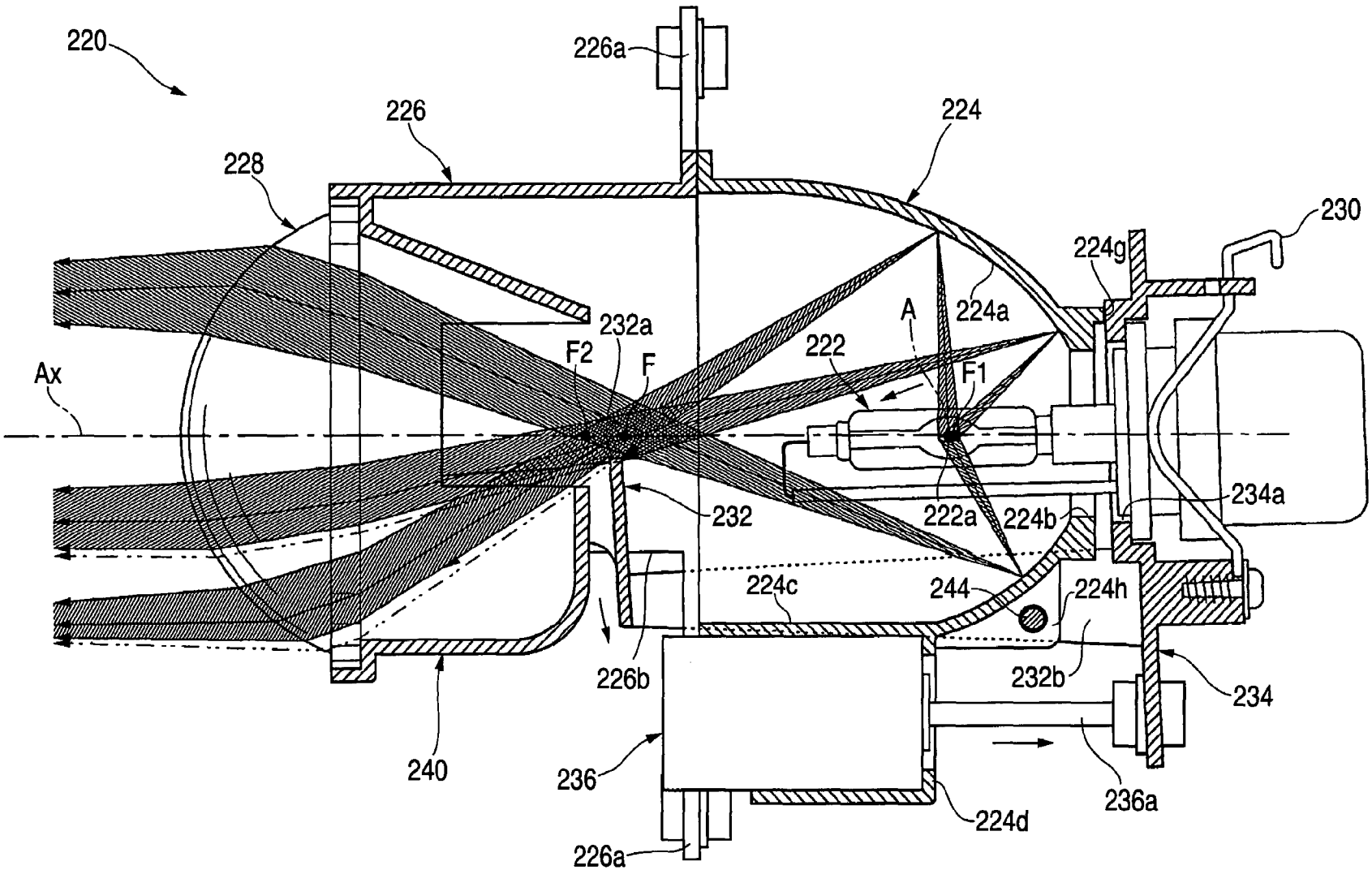
FIG. 16 is a side sectional view showing an optical path resulting when the bulb support base is located at a second shift position.

FIG. 15 is a drawing which shows an optical path resulting when the bulb support base 234 is located at the first shift position, and FIG. 16 is a drawing which shows an optical path resulting when the bulb support member 234 is located at the second shift position.

As shown in FIG. 15, since the movable shade 232 is located at the first shade position when the bulb support base 234 is located at the first shift position, part of reflected light from the reflector 224 is intercepted by the movable shade 232, and the remaining portion of the reflected light is incident on the projection lens 228.

On the other hand, as shown in FIG. 16, since the movable shade 232 is located at the second shade position when the bulb support member 234 is located at the second shift position, substantially the whole of reflected light from the reflector 224 is incident on the projection lens 228 without being intercepted by the movable shade 232. In addition, as this occurs, since the light source 222*a* is located at the second light source position, the degree at which reflected light from the reflector is collected on the rear focal plane of the projection lens 228 is made higher than when the light source 222*a* is located at the first light source position.

Figure 17A:
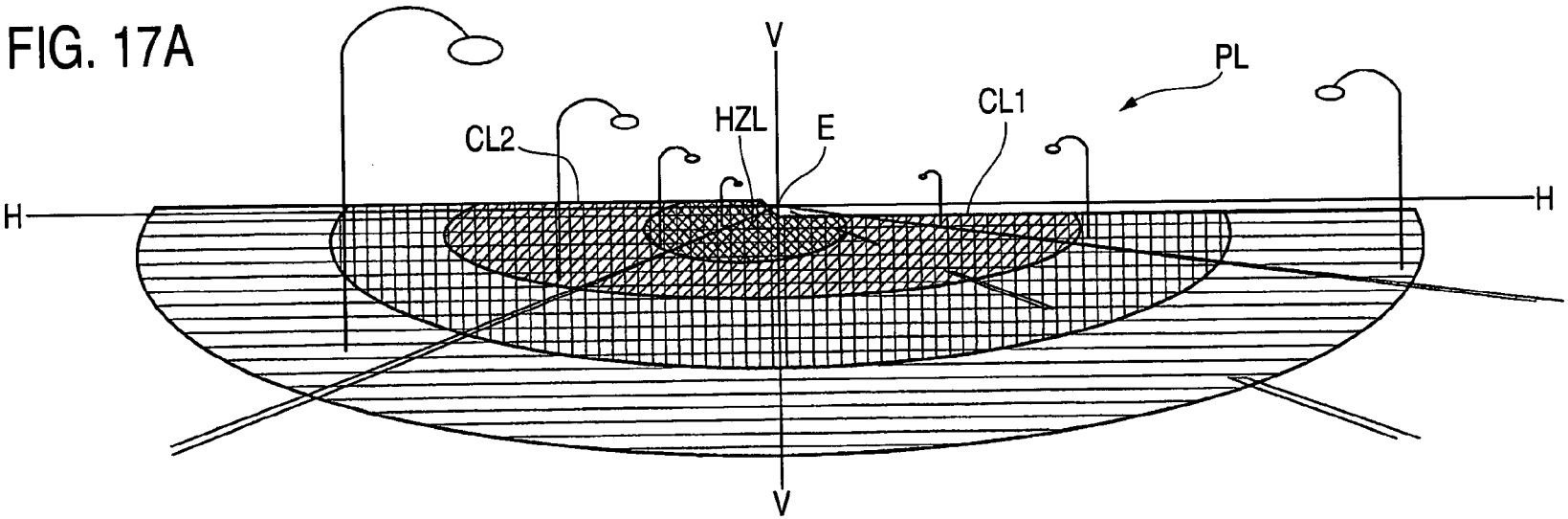
FIG. 17A is a perspective view of a light distribution pattern formed on an imaginary perpendicular screen disposed at a distance of 25 m ahead of the lamp by light emitted forward from the vehicle headlamp, and showing a low beam light distribution pattern formed when the bulb support member is located at the first shift position.
Figure 17B:
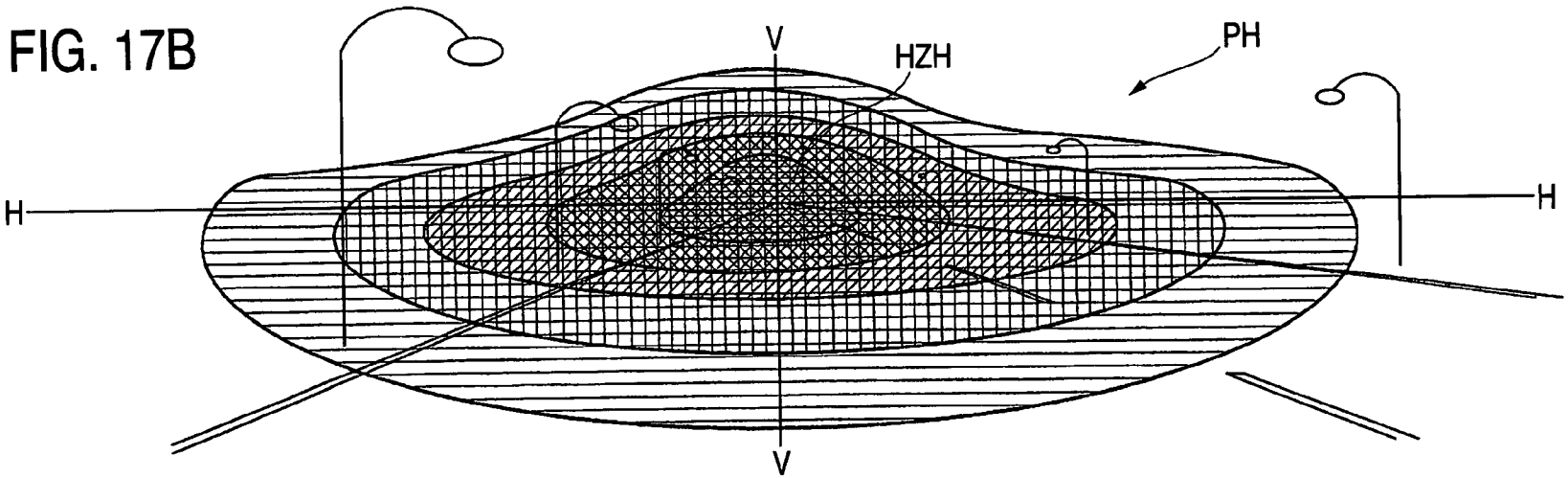
FIG. 17B is a perspective view of a light distribution pattern formed on an imaginary perpendicular screen disposed at a distance of 25 m ahead of the lamp by light emitted forward from the vehicle headlamp, and showing a high beam light distribution pattern formed when the bulb support member is located at the second shift position.

FIGS. 17A and 17B show perspective views of light distribution patterns which are formed on an imaginary perpendicular screen disposed at a distance of 25 m in front of the lamp by light emitted forward from the vehicle headlamp 210.

A light distribution pattern PL1 shown in FIG. 17A is a low beam light distribution pattern which is to be formed when the bulb support member 234 is located at the first shift position, and a light distribution pattern PH shown in FIG. 6B is a high beam light distribution pattern which is to be formed when the bulb support member 234 is located at the second shift position.

As shown in FIG. 17A, the low beam light distribution pattern PL is a low beam light distribution pattern designed for a left-hand side traffic in which vehicles are driven on the left-hand side of the road and has transversely stepped cut-off lines CL1, CL2 along an upper end edge thereof. The cut-off lines CL1, CL2 extend horizontally at different levels which are transversely stepped up or down from each other across a boundary constituted by a V-V line which passes perpendicularly through an H-V point which is a vanishing point in a forward direction of the lamp, wherein a portion situated rightward of the line V-V, which constitutes an on-coming vehicle lane portion, is formed as the lower cut-off line CL1, whereas a portion situated leftward of the line V-V, which constitutes a subject vehicle lane portion, is formed as the upper cut-off line CL2 which is stepped upward from the lower cut-off line CL1 via a slope portion. In this low beam light distribution pattern PL, the position of an elbow point E, which is an intersection point between the lower cut-off line CL2 and the line V-V, is set at a position located on the order of 0.5 to 0.6° further downward than the H-V point, and a hot zone HZL, which is a high luminous intensity area, is formed in such a manner as to include the elbow point E in a slightly leftward area of the hot zone HZL.

This low beam light distribution pattern PL is formed by projecting an image of the light source 222*a* formed on the rear focal plane of the projection lens 228 by light from the light source 222*a* which is reflected on the reflecting surface 224*a* of the reflector 224 on to the imaginary perpendicular screen as an inverted projection image by the projection lens 228, and the cut-off lines CL1, CL2 thereof are formed as an inverted projection image of the upper end edge 232*a* of the movable shade 232.

On the other hand, as shown in FIG. 17B, the high beam light distribution pattern PH has a shape resulting when the low beam light distribution pattern PL is expanded as far as an area above the cut-off lines CL1, CL2 thereof and a hot zone HZH is formed about the H-V point. This is because the interception of the reflected light from the reflector 224 by the movable shade 232 is released by virtue of the moving of the movable shade 232 from the first shade position to the second shade position.

As this occurs, the high beam light distribution pattern PH so formed is made such that the overall diffusion angle is smaller than that of the low beam light distribution pattern PL and the hot zone HZH is brighter than that of the low beam light distribution pattern PL. This is because the degree at which reflected light from the reflector 224 is collected on the rear focal plane of the projection lens 228 is increased when the light source 222*a* is located at the second light source position than when at the first light source position.

Thus, as has been described heretofore, while the lamp unit 220 of the vehicle headlamp 210 according to the embodiment is constructed as the projector type lamp unit with the movable shade 232, since the light source 222*a* and the movable shade 232 thereof are supported by the bulb support base 234 which is a support member common thereto and the bulb support member 234 is made to be moved by the driving device 236 between the first and second shift positions, the following function and advantage can be obtained.

Namely, according to the lamp unit 220 according to the embodiment, although there is provided only the single light source 222*a*, the low beam light distribution pattern PL and the high beam light distribution pattern PH can selectively be formed.

As this occurs, at the first shift position, since the light source 222*a* is located at the first light source position which is situated on the optical axis Ax and the movable shade 232 is located at the first shade position where the upper end edge 232*a* of the movable shade 232 is positioned near to the optical axis Ax in the vicinity of the rear focal point F of the projection lens 228, part of reflected light from the reflector 224 is intercepted by the movable shade 232, whereby the low beam light distribution pattern PL can be obtained which has the cut-off lines CL1, CL2 as an inverted image of the upper end edge 232*a* of the movable shade 232 at the upper end portion thereof.

On the other hand, at the second shift position, since the light source 222*a* is located at the second light source position which is positioned further forward than the first light source position and the movable shade 232 is located at the second shade position where the position of the upper end edge 232*a* thereof is located at the position which is further downward than the position which results when the movable shade 232 is located at the first shade position, the high beam light distribution pattern PH can be formed.

As this occurs, by moving the light source 222*a* from the first light source position to the second light source position, the degree at which reflected light from the reflector 224 is collected on the rear focal point of the projection lens 228 can be increased, and by moving the movable shade 232 from the first shade position to the second shade position, light is allowed to be emitted as far as above the position of the cut-off lines CL1, CL2, whereby the high beam light distribution pattern PH can be made a light distribution pattern which has a smaller overall diffusion angle and a higher center luminous intensity than the low beam light distribution pattern PL and which is hence superior in far-field visibility.

Thus, according to the embodiment, in the projector type vehicle headlamp 210 with the movable shade 232, the high beam light distribution pattern PH can be made the light distribution pattern which is superior in the far-field visibility without affecting the low beam light distribution pattern PL adversely.

Moreover, in the embodiment, since the aforesaid functions and advantages can be obtained at the single driving position 236, the lamp can be made lighter in weight and smaller in size than when a plurality of driving positions are used, and hence the reduction in production costs of the lamp can be realized.

Furthermore, in the embodiment, since the move of the light source and the move of the movable shade are implemented in a completely synchronized fashion, the aforesaid functions and advantages can be obtained without the driver having to feel a physical disorder.

As this occurs, in the vehicle headlamp 210 according to the embodiment, since the reflecting surface 224*a* of the reflector 224 has the substantially oval perpendicular cross section which takes the first light source position as the first focal point F1 and the point which is located further forward than the rear focal point F on the optical axis Ax as the second focal point F2, the following function and advantage can be obtained.

Namely, by setting the shape of the perpendicular cross section of the reflecting surface 224*a* of the reflector 224 to the substantially oval shape and setting the second focal point F2 thereof at the position further forward than the rear focal point F of the projection lens 228, the degree at which reflected light from the reflector is collected on the rear focal plane of the projection lens 228 can be mitigated when compared with the case where the position of the second focal point F2 is set at the rear focal point F of the projection lens 228, whereby the low beam light distribution pattern PL can be made a light distribution pattern having a relatively large diffusion angle. On the other hand, since the convergence position of reflected light from the reflector 224 is shifted from the second focal point F2 to a position that is further rearward than the same focal point when the light source 222*a* is moved forward from the first focal point F1, by setting the second focal point F2 at the position which is further forward than the rear focal point F of the projection lens 228, the degree at which reflected light from the reflector is collected on the rear focal plane of the projection lens 228 can be increased, whereby it is possible to obtain in an ensured fashion the high beam light distribution pattern PH which has the smaller overall diffusion angle and the higher center luminous intensity than the low beam light distribution pattern PL.

Next, a modified example of the embodiment will be described.

Figure 18:
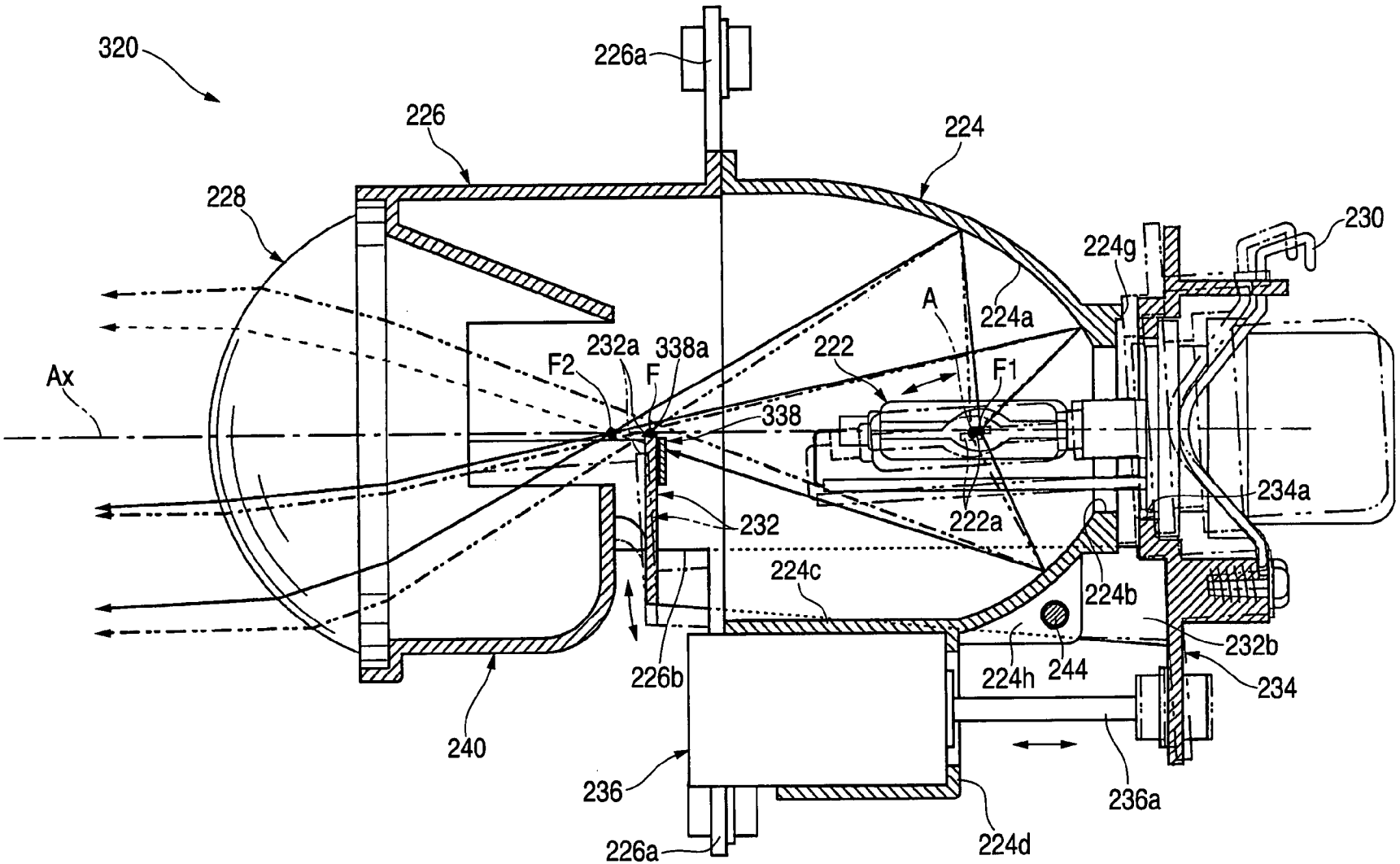
FIG. 18 is a similar drawing to FIG. 13, which shows a lamp unit according to a modified example.

FIG. 18 is a similar drawing to FIG. 13, which shows a lamp unit 320 according to this modified example. As shown in the FIG. 18, while the lamp unit 320 is similar to the lamp unit 220 according to the embodiment with respect to a basic configuration thereof but differs from the lamp unit 220 according to the embodiment in that a stationary shade 338 is provided in the vicinity of the rear focal point F of the projection lens 228.

This stationary shade 338 is made up of a belt-like plate which extends horizontally in an arc-like fashion in such a manner as to approach a rear side of the movable shade 232 and is fixed to the holder 226 at both end portions thereof. An upper end edge 338*a* of the stationary shade 338 is formed in such a manner as to be stepped transversely or to form a transverse step as with the upper end edge 232*a* of the movable shade 232, and a height position thereof is set to a height position between the height position of the upper end edge 232*a* of the movable shade 232 when the movable shade 232 is located at the first shade position and the height position of the upper end edge 232*a* of the movable shade 232 when the movable shade 232 is located at the second shade position. To be specific, the upper end edge 338*a* of the stationary shade 338 is set at a position which is on the order of 0.3 to 0.4 mm further downward than the upper end edge 232*a* of the movable shade 232 when the movable shade is located at the first shade position.

Figure 19:
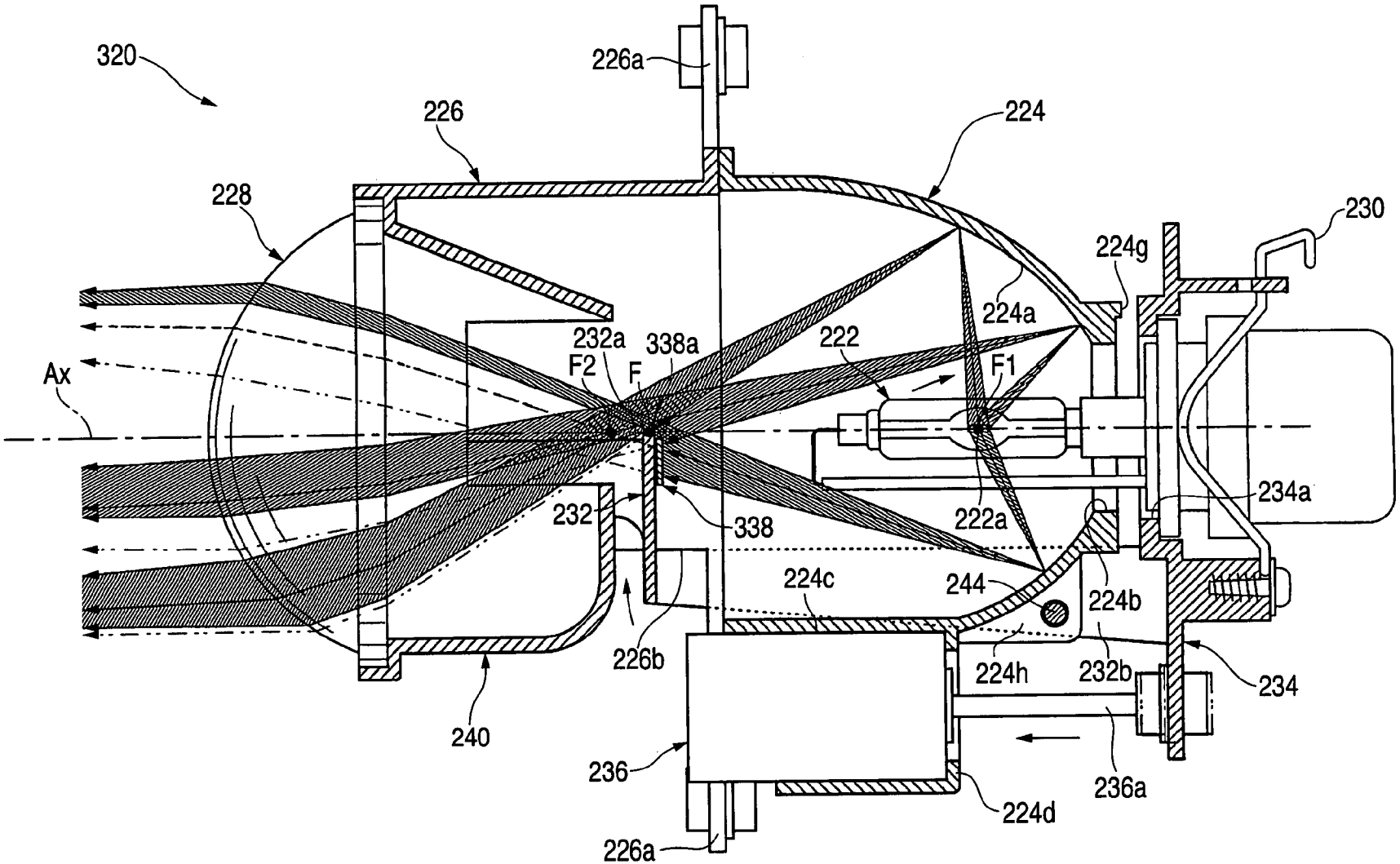
FIG. 19 is a side sectional view showing an optical path resulting when the bulb support base is located at the first shift position in the modified example.
Figure 20:
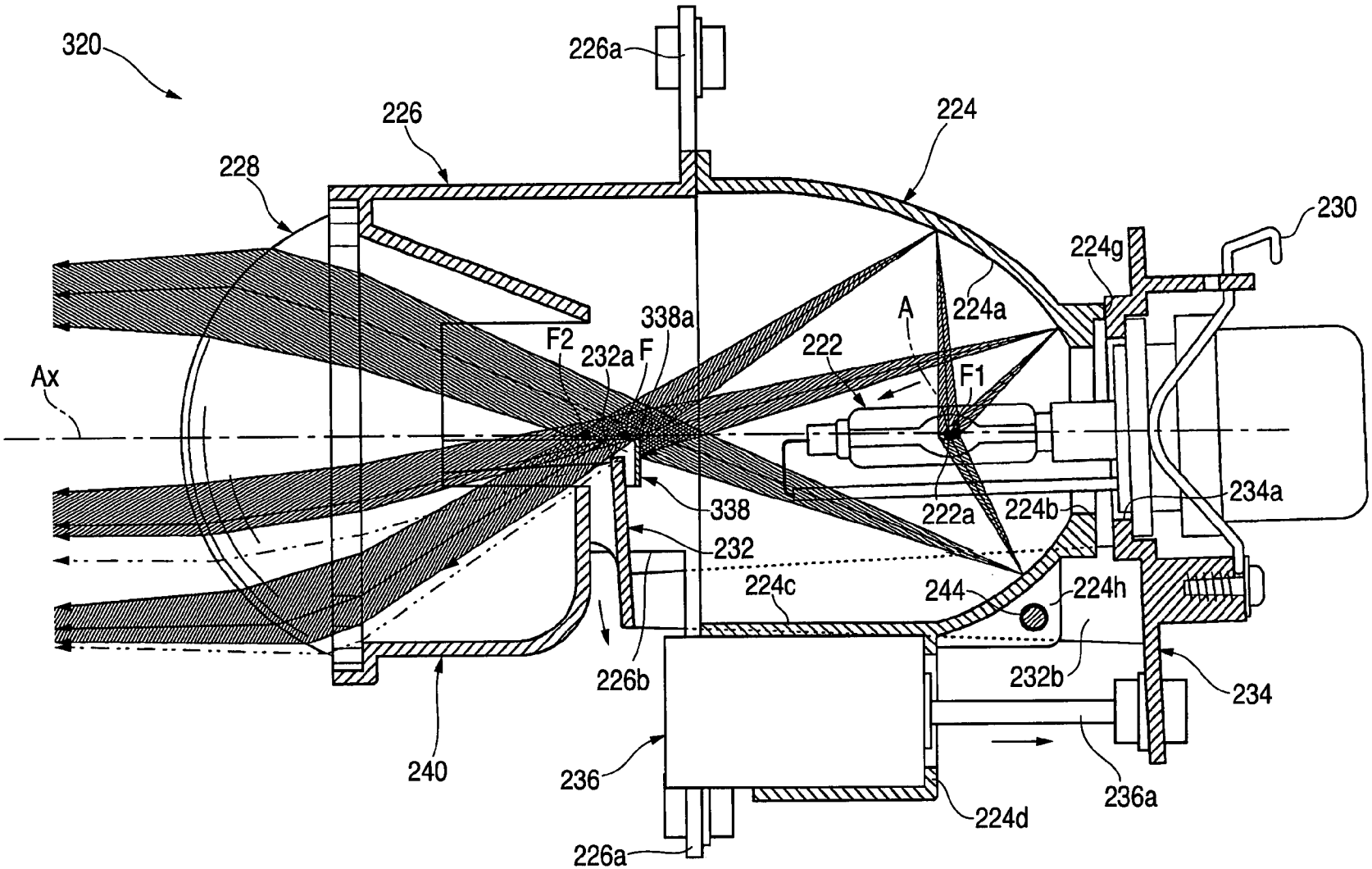
FIG. 20 is a side sectional view showing an optical path resulting when the bulb support base is located at the second shift position in the modified example.

FIG. 19 is a drawing which shows an optical path resulting when the bulb support base 234 is located at the first shift position, and FIG. 20 is a drawing which shows an optical path resulting when the bulb support member 34 is located at the second shift position.

As shown in FIG. 19, since the movable shade 232 is located at the first shade position when the bulb support member 234 is located at the first shift position, reflected light from the reflector 224 is partially intercepted by the movable shade 232, and the remaining portion of the reflected light is incident on the projection lens 228. As this occurs, since the stationary shade 338 is close to the rear side of the movable shade 232 and the upper end edge 338*a* thereof is situated slightly further downward than the upper end-edge 232*a* of the movable shade 232, reflected light from the reflector 224 which is intercepted by the stationary shade 338 is also totally intercepted by the movable shade 232. Consequently, in this case, the stationary shade 338 has no specific meaning from the optical point of view.

On the other hand, as shown in FIG. 20, while the movable shade 232 is moved to the second shade position when the bulb support base 234 is moved to the second shift position, since the stationary shade 338 remains at the original position thereof, reflected light from the reflector 224 is partially intercepted by the stationary shade 338, and the remaining potion thereof is incident on the projection lens 228. In addition, as this occurs, since the light source 222*a* is moved to the second shift position, the degree at which reflected light from the reflector 24 is collected on the rear focal plane of the projection lens 228 is increased.

Figure 21A:
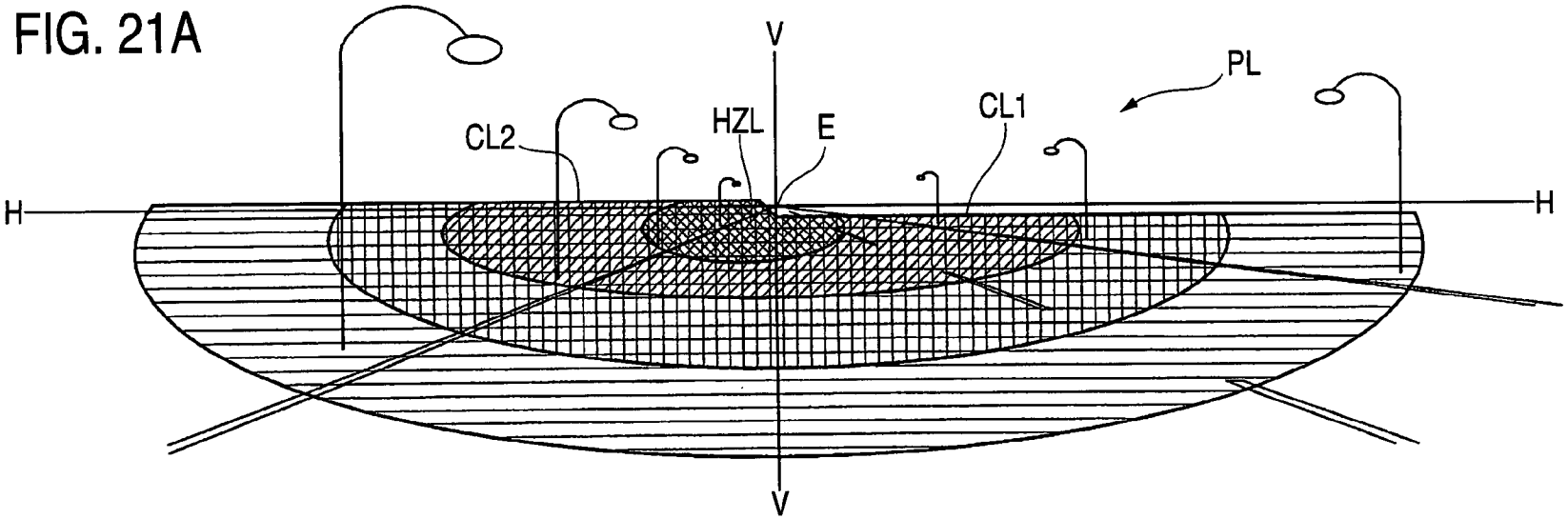
FIG. 21A is a perspective view of a light distribution pattern formed on the imaginary perpendicular screen by light emitted forward from a vehicle headlamp provided with the lamp unit according to the modified example, and showing a low beam light distribution pattern formed when the bulb support base is located at a first shift position.
Figure 21B:
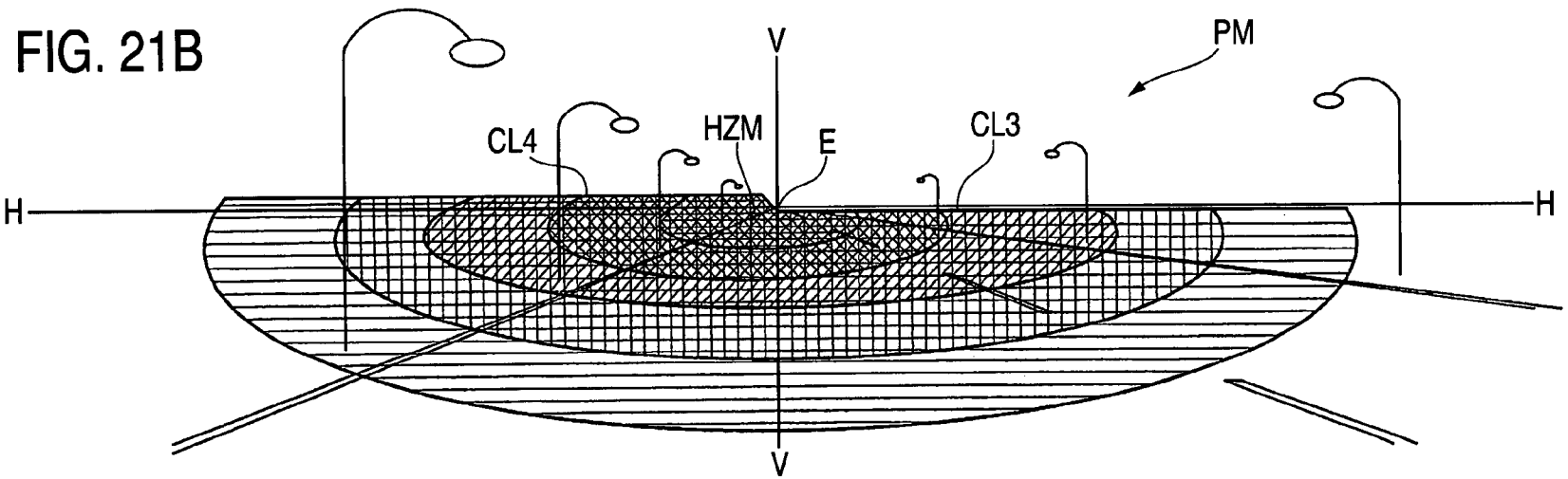
FIG. 21B is a perspective view of a light distribution pattern formed on the imaginary perpendicular screen by light emitted forward from a vehicle headlamp provided with the lamp unit according to the modified example, and showing an intermediate light distribution pattern formed when the bulb support base is located at a second shift position.

FIGS. 21A and 21B shows perspective views which illustrate light distribution patterns that are formed on the imaginary perpendicular screen disposed at a distance of 25 mm in front of the lamp by light emitted forward from the vehicle headlamp with the lamp unit 320 according to the modified example.

A light distribution pattern PL shown in FIG. 21A is a low beam light distribution pattern that is to be formed when the bulb support base 234 is located at the first shift position, and a light distribution pattern PM shown in FIG. 21B is an intermediate light distribution pattern that is to be formed when the bulb support base 234 is located at the second shift position.

As shown in FIG. 21A, the low beam light distribution pattern PL becomes a light distribution pattern which is totally identical to the low beam light distribution pattern PL of the embodiment.

On the other hand, as shown in FIG. 21B, the intermediate light distribution pattern PM is an intermediate light distribution pattern between the low beam light distribution pattern PL and the high beam light distribution pattern PH and is similar to the low beam light distribution pattern PL. However, cut-off lines CL3, CL4 of the intermediate light distribution pattern PM are situated on the order of 0.3 to 0.4 mm further upward than the cut-off lines CL1, CL2 of the low beam light distribution pattern PL.

This is because while the interception of reflected light from the reflector 224 by the movable shade 232 is released due to the movable shade 232 being moved from the first shade position to the second shade position, the interception by the stationary shade 338 still remains, whereby the cut-off lines CL3, CL4 are formed as an inverted-image of the upper end edge 338*a* of the stationary shade 338.

In addition, the intermediate light distribution pattern PM is made such that the overall diffusion angle is smaller than that of the low beam light distribution pattern PL and a hot zone HZM is brighter than the hot zone HZL of the low beam light distribution pattern PL. This is because the degree at which reflected light from the reflector 224 is collected on the rear focal plane of the projection lens 228 is increased when the light source 222*a* is located at the second light source position than when at the fist light source position.

The following function and advantage can be obtained by adopting the modified example that is configured as has been described heretofore.

Namely, in the lamp unit 320 according to the modified example, although there is provided only the single light source 222*a*, the low beam light distribution pattern PL and the intermediate light distribution pattern PM can selectively be formed.

As this occurs, since the hot zone HZM of the intermediate light distribution pattern PM is expanded further upward than the hot zone HZL of the low beam light distribution pattern PL, the visibility in the far field area on the road surface ahead of the vehicle can be increased, and moreover, in the intermediate light distribution pattern PM, since the interception by the movable shade 232 is not totally released but the cut-off lines CL3, CL4, which are made to deviate upward relative to the cut-off lines CL1, CL2, are left by the stationary shade 338, the driver of an oncoming vehicle can be prevented from being dazzled largely by glare that would otherwise be provided by the lamp unit.

In addition, in attempting to obtain the intermediate light distribution pattern PM having the cut-off lines CL3, CL4 along the upper end edge thereof by the movable shade 232 only, while the shift amount of the movable shade 232 between the first and second shade position needs to be set to a relatively small value, since the movable shade 232, together with the light source bulb 222, is supported by the bulb support base 234, in the event that the first and second light source positions are set at preferable positions, there may be caused a risk that the second shade position is spaced away largely from the first shade position. However, in this regard, in the lamp unit 320 according to this modified example, since the stationary shade. 338 is provided in the vicinity of the rear focal point F of the projection lens 228 and the position of the upper end edge 338*a* of the stationary shade 338 is set to a position which is suitable for the formation of the cut-off lines CL3, CL4, the second shade position can be set arbitrarily to some extent, whereby the degree of freedom in designing the lamp can be increased.

In addition, in the embodiment and the modified example therefrom, while the lamp units 220, 320 are configured so as to form a low beam light distribution pattern for the left-hand side traffic in which vehicles are driven on the left-hand side of the road as the low beam light distribution pattern PL, the same functions and advantages as those provided by the light distribution pattern for the left-hand side traffic can be obtained by adopting the same configurations as those of the embodiment and the modified example even in the event that the lamp units 220, 320 are attempted to be configured so as to form a low beam light distribution pattern for a right-hand side traffic in which vehicles are driven on the right-hand side of the road.

The vehicle headlamp according to one or more embodiments of the invention is configured as the projector type vehicle headlamp with the movable shade, since the movable shade is configured so as to be moved by shade driving device between the first shade position where the upper end edge of the movable shade is located close to the optical axis in the vicinity of the rear focal point of the projection lens and the second shade position where the position of the upper end edge is located below the position thereof resulting when the movable shade is located at the first shade position, even with the single light source, the low beam light distribution pattern and the high beam light distribution pattern or the intermediate light distribution pattern can selectively be formed.

Moreover, since the vehicle headlamp according to one or more embodiment of the invention, the light source is configured so as to be moved between the first light source position which is located in the vicinity of the optical axis and the second light source position which is located further forward than the first light source position, four types of light distribution patterns can be obtained by combining the positions of the light source with the positions of the movable shade.

Namely, since when the light source is located at the first light source position and the movable shade is located at the first shade position, part of the reflected light from the reflector is intercepted by the movable shade, a first low beam light distribution pattern can be obtained which has a cut-off line as an inverted image of the upper end edge of the movable shade. Then, in case the movable shade is moved to the second shade position from this state, the whole or part of the interception of the reflected light by the movable shade is released, and therefore, light is then allowed to illuminate as far as above the cut-off line of the first low beam light distribution pattern, whereby a first high beam light distribution pattern or intermediate light distribution pattern can be obtained.

Note that while the intermediate light distribution pattern can be formed by setting the second shade position at a position which is closer to the first shade position than when forming the high beam light distribution pattern, as this occurs, in the event that the second shade position is set at a position which is relatively close to the first shade position, this intermediate light distribution pattern can be made a light distribution pattern having a cut-off line which results as if when the cut-off line of the low beam light distribution pattern is moved upward in parallel.

On the other hand, the degree at which reflected light from the reflector is collected on a rear focal plane of the projection lens can be increased in the event that the light source is moved to the second light source position from such a state that the light source is located at the first light source position and the movable shade is located at the first shade position. Then, by realizing this, a second low beam light distribution pattern can be obtained which has a smaller overall diffusion angle and a higher center luminous intensity than the first low beam light distribution pattern while maintaining a light distribution pattern shape having a cut-off line at an upper end portion as with the first low beam light distribution pattern.

In addition, since light is allowed to illuminate as far as above the cut-off line of the first low beam light distribution pattern in such a state that the degree at which reflected light from the reflector is collected on the rear focal plane of the projection lens is increased in the event that the light source is moved to the second light source position and the movable shade is moved to the second shade position from such a state that the light source is located at the first light source position and the movable shade is located at the first shade position, a second high beam light distribution pattern or intermediate light distribution pattern can be obtained which has a smaller overall diffusion angle and a higher center luminous intensity than the first high beam light distribution pattern or intermediate light distribution pattern.

Then, in the event that any of these four types of light distribution patterns is made to be selected appropriately according to the driving condition of the vehicle, the safety and comfortableness can be increased while driving at night.

Namely, in the event that, of the low beam light distribution patterns, the first low beam light distribution pattern, which can illuminate widely the near field area in front of the vehicle, is selected when driving in an urban area or the like, whereas the second low beam light distribution patter, which is superior in visibility in the far field area in front of the vehicle, is selected when driving at high speeds or the like, the safety and comfortableness can be increased when driving at night with the low beam.

In addition, in the event that, of the high beam light distribution patterns or intermediate light distribution patterns, the first high beam light distribution pattern or intermediate light distribution pattern, which can illuminate widely in the near field in front of the vehicle, is selected when driving on a curved road in a mountainous area or the like, whereas the second high beam light distribution pattern or intermediate light distribution pattern, which is superior in visibility in the far field in front of the vehicle, is selected when driving on a rectilinear roadway at high speeds or the like, the safety and comfortableness can be increased when driving at night with the high beam or intermediate beam (namely, the intermediate beam between the low beam and the high beam).

Thus, according to one or more embodiment of the invention, in the projector type vehicle headlamp with the movable shade, an appropriate light distribution pattern can be formed even when the movable shade is moved to either of its positions.

While, as has been mentioned before, there is no particular limitation that is imposed on the shape of the reflecting surface of the reflector, in the event that the reflecting surface of the reflector is formed into the shape with a substantially oval perpendicular cross section which takes, as a first focal point, a point in the vicinity of the first light source position and, as a second focal point, a point which is located further forward than the rear focal point of the projection lens in the vicinity of the optical axis, the following function and advantage can be obtained.

Namely, by setting the shape of the perpendicular cross section of the reflecting surface of the reflector to the substantially oval shape and setting the second focal point thereof at the position further forward than the rear focal point of the projection lens, the degree at which reflected light from the reflector is collected on the rear focal plane of the projection lens can be mitigated when compared with a case where the position of the second focal point is set at the rear focal point of the projection lens, whereby the first low beam light distribution pattern and the first high beam light distribution pattern or intermediate light distribution pattern can be made a light distribution pattern having a relatively large diffusion angle. On the other hand, since the convergence position of reflected light from the reflector is shifted from the second focal point to a position that is further rearward than the same focal point when the light source is moved forward from the first focal point, by setting the second focal point at the position which is further forward than the rear focal point of the projection lens, the degree at which reflected light from the reflector is collected on the rear focal plane of the projection lens can be increased which results when the light source is moved to the second light source position, whereby it is possible to obtain in an ensured fashion the second low beam light distribution pattern and the second high beam light distribution pattern or intermediate light distribution pattern which have the smaller overall diffusion angle and the higher center luminous intensity than the first low beam light distribution pattern and the first high beam light distribution pattern or intermediate light distribution pattern.

In addition, in the aforesaid configuration, in the event that the second light source position is set at a position below the first light source position, the following function and advantage can be obtained.

Namely, in the event that the second light source position is set at the position which is forward and below relative to the first light source position, when compared with a case where the second light source position is set at a position which is at the same height as and further forward than the first light source position, the position where reflected light from the reflector is incident on the rear focal plane of the projection lens can be made to deviate upward, whereby since the interception quantity of reflected light from the reflector by the movable shade can be kept small, the luminous flux of the light source can be utilized effectively, thereby making it possible to make the second low beam light distribution pattern brighter.

Moreover, the vehicle headlamp according to one or more embodiments of the invention is configured as the projector type vehicle headlamp with the movable shade, since the light source and the movable shade are supported on the common support member and the support member is made to be moved by the driving device between the first and second shift positions, the following functions and advantages can be obtained.

Namely, at the first shift position, since the light source is located at the first light source position which is situated in the vicinity of the optical axis and the movable shade is located at the first shade position where the upper end edge of the movable shade is positioned near to the optical axis in the vicinity of the rear focal point of the projection lens, part of reflected light from the reflector is intercepted by the movable shade, whereby a low beam light distribution pattern can be obtained which has a cut-off line as an inverted image of the upper end edge of the movable shade at an upper end portion thereof.

On the other hand, at the second shift position, since the light source is located at the second light source position which is positioned further forward than the first light source position and the movable shade is located at the second shade position where the position of the upper end edge thereof is located at the position which is further downward than the position which results when the movable shade is located at the first shade position, a high beam light distribution pattern or intermediate light distribution pattern can be formed.

Note that while the intermediate light distribution pattern can be formed by setting the second shade position at a position which is closer to the first shade position than when forming the high beam light distribution pattern, as this occurs, in the event that the second shade position is set at a position which is relatively close to the first shade position, this intermediate light distribution pattern can be made a light distribution pattern having a cut-off line which results as if when the cut-off line of the low beam light distribution pattern is moved upward in parallel.

Then, by moving the light source from the first light source position to the second light source position, the degree at which reflected light from the reflector is collected on the rear focal point of the projection lens can be increased, and by moving the movable shade from the first shade position to the second shade position, light is allowed to be emitted as far as above the position of the cut-off line of the low beam light distribution pattern, whereby the high beam light distribution pattern or intermediate light distribution pattern can be made a light distribution pattern which has a smaller overall diffusion angle and a higher center luminous intensity than the low beam light distribution pattern and which is hence superior in far-field visibility.

Thus, according to one or more embodiments of the invention, in the projector type vehicle headlamp with the movable shade, the high beam light distribution pattern or intermediate light distribution pattern can be made the light distribution pattern which is superior in the far-field visibility without affecting the low beam light distribution pattern adversely.

Moreover, in one or more embodiments of the invention, since the aforesaid functions and advantages can be obtained at the single driving position, the lamp can be made lighter in weight and smaller in size than when a plurality of driving positions are used, and hence the reduction in production costs of the lamp can be realized.

Furthermore, in one or more embodiments of the invention, since the move of the light source and the move of the movable shade are implemented in a completely synchronized fashion, the aforesaid functions and advantages can be obtained without the driver having to feel a physical disorder.

In addition, in the above configuration, in the event that a stationary shade for intercepting part of reflected light from the reflector is provided in the vicinity of the rear focal point and the height position of an upper end edge of the stationary shade is set at a height position between an upper end edge of the movable shade which results when the movable shade is located at the first shade position and a height position of the upper end edge of the movable shade which results when the movable shade is located at the second shade position, the following function and advantage can be obtained.

Namely, in attempting to obtain as an intermediate light distribution pattern a light distribution pattern having a cut-off line at an upper end edge thereof, the shift amount of the movable shade between the first and second shade position needs to be set to a relatively small value. However, since this movable shade, together with the light source, is supported by the common support member, in the event that the first and second light source positions are set at preferable positions, there may be caused a risk that the second shade position is spaced away largely from the first shade position depending upon the configuration of the support member. Then, in the event that the stationary shade is provided in the vicinity of the rear focal point and the position of the upper end edge of the stationary shade is set to a position which is suitable for the formation of the cut-off line of the intermediate light distribution pattern, the second shade position can be set arbitrarily to some extent, whereby the degree of freedom in designing the lamp can be increased.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A vehicle headlamp comprising:

a projection lens;

a reflector;

a light source movable with respect to the reflector between a first light source position and a second light source position; and a movable shade movable between a first shade position and a second shade position, wherein the light source and the movable shade are able to interlock.

2. The vehicle headlamp according to claim 1, wherein the projection lens is disposed on an optical axis extending in a longitudinal direction of a vehicle, the light source is disposed flirt her rearward than a rear focal point of the projection lens, the reflector reflects light from the light source forward so as to approach the optical axis, the movable shade intercepts part of reflected light from the reflector, the first light source position is located in the vicinity of the optical axis, the second light source position is located further forward than the first light source position with respect to the reflector, in the first shade position, an upper end edge of the movable shade is located close to the optical axis in the vicinity of the rear focal point, and in the second shade position, the upper end edge is located below a position when the movable shade is located at the first shade position.

3. The vehicle headlamp according to claim 2, wherein a reflecting surface of the reflector has a substantially elliptical cross section having a first focal point close to the first light source position and a second focal point located further forward than the rear focal point in the vicinity of the optical axis.

4. The vehicle headlamp according to claim 1, wherein the second light source position is located further downward than the first light source position.

5. The vehicle headlamp according to claim 2, wherein the second light source position is located further downward than the first light source position.

6. The vehicle headlamp according to claim 3, wherein the second light source position is located further downward than the first light source position.

7. The vehicle headlamp according to claim 2, further comprising:

a stationary shade disposed in the vicinity of a rear focal point of the projection lens and intercepts part of reflected light from the reflector, wherein the height position of an upper end edge of the stationary shade is positioned between a height position of an upper end edge of the movable shade when the movable shade is located at the first shade position and a height position of the upper end edge of the movable shade when the movable shade is located at the second shade position.

8. The vehicle headlamp according to claim 1, further comprising:

a light source driving device that drives the light source; and a shade driving device that drive the movable shade.

9. The vehicle headlamp according to claim 1, wherein the light source and the movable shade are supported by a common support member.

10. The vehicle headlamp according to claim 1, wherein the second light source position is located further forward than the first light source position.

11. The vehicle headlamp according to claim 10, wherein the second light source position is located further downward than the first light source position.

12. The vehicle headlamp according to claim 2, further comprising:

a light source driving device that drives the light source; and a shade driving device that drive the movable shade.

13. The vehicle headlamp according to claim 2, wherein the light source and the movable shade are supported by a common support member.

14. The vehicle headlamp according to claim 13, wherein the support member is moved by a driving device between a first shift position where the light source is located at the first light source position and the movable shade is located at the first shade position and a second shift position where the light source is located at the second light source position and the movable shade is located at the second shade position.

15. The vehicle headlamp according to claim 8, wherein a reflecting surface of the reflector has a substantially elliptical cross section having a first focal point close to the first light source position and a second focal point located further forward than the rear focal point in the vicinity of the optical axis.

16. The vehicle headlamp according to claim 8, wherein the second light source position is located further downward than the first light source position.

17. A vehicle headlamp comprising:

a projection lens;

a light source movable between a first light source position and a second light source position;

a reflector;

a movable shade movable between a first shade position and a second shade position; and a stationary shade disposed in the vicinity of rear focal point of the projection lens and intercepts part of reflected light from the reflector, wherein the light source and the movable shade are able to interlock, and wherein the height position of an upper end edge of the stationary shade is positioned between a height position of an upper end edge of the movable shade when the movable shade is located at the first shade position and a height position of the upper end edge of the movable shade when the movable shade is located at the second shade position.

18. A vehicle head lamp comprising:

a projection lens;

a light source movable between a first light source position and a second light source position;

a reflector;

a movable shade movable between a first shade position and a second shade position, wherein the light source and the movable shade are able to interlock, wherein the light source and the movable shade are supported by a common support member, and wherein the support member is moved by a driving device between a first shift position where the light source is located at the first light source position and the movable shade is located at the first shade position and a second shift position where the light source is located at the second light source position and the movable shade is located at the second shade position.

19. The vehicle headlamp according to claim 18, wherein a reflecting surface of the reflector has a substantially elliptical cross section having a first focal point close to the first light source position and a second focal point located further forward than the rear focal point in the vicinity of the optical axis.

20. The vehicle headlamp according to claim 18, further comprising:

a stationary shade disposed in the vicinity of a rear focal point of the projection lens and intercepts part of reflected light from the reflector, wherein the height position of an upper end edge of the stationary shade is positioned between a height position of an upper end edge of the movable shade when the movable shade is located at the first shade position and a height position of the upper end edge of the movable shade when the movable shade is located at the second shade position.

* * * * *